US010166771B2

(12) United States Patent
Kasai et al.

(10) Patent No.: US 10,166,771 B2
(45) Date of Patent: Jan. 1, 2019

(54) LIQUID EJECTION METHOD, LIQUID EJECTION APPARATUS, AND LIQUID EJECTION HEAD

(71) Applicant: CANON KABUSHIKI KAISHA, Tokyo (JP)

(72) Inventors: Shintaro Kasai, Yokohama (JP); Yoshiyuki Nakagawa, Kawasaki (JP); Akiko Saito, Tokyo (JP); Shinji Kishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/647,074

(22) Filed: Jul. 11, 2017

(65) Prior Publication Data

US 2018/0015722 A1 Jan. 18, 2018

(30) Foreign Application Priority Data

Jul. 15, 2016 (JP) ..... 2016-140350

(51) Int. Cl.
*B41J 2/14* (2006.01)
*B41J 2/045* (2006.01)

(52) U.S. Cl.
CPC ..... *B41J 2/14088* (2013.01); *B41J 2/0458* (2013.01); *B41J 2/04588* (2013.01); *B41J 2/04598* (2013.01); *B41J 2/1404* (2013.01); *B41J 2/14016* (2013.01); *B41J 2/14024* (2013.01); *B41J 2002/14169* (2013.01); *B41J 2002/14467* (2013.01); *B41J 2202/12* (2013.01); *B41J 2202/20* (2013.01)

(58) Field of Classification Search
CPC .. B41J 2/14088; B41J 2/14024; B41J 2/0458; B41J 2/04588; B41J 2/1404; B41J 2/04598; B41J 2/14016; B41J 2202/12; B41J 2002/14169; B41J 2002/14467; B41J 2202/20
See application file for complete search history.

(56) References Cited

U.S. PATENT DOCUMENTS

2002/0109754 A1* 8/2002 Fujii ..... B41J 2/04506 347/57
2004/0179070 A1 9/2004 Hamazaki
2011/0205303 A1 8/2011 Pan

FOREIGN PATENT DOCUMENTS

EP 1016525 A2 7/2000
EP 1033249 A1 9/2000
EP 1092544 A2 4/2001

* cited by examiner

*Primary Examiner* — Bradley Thies
(74) *Attorney, Agent, or Firm* — Canon U.S.A., Inc. IP Division

(57) ABSTRACT

A liquid ejection method includes ejecting liquid from an ejection opening, using a liquid ejection head including a heating surface configured to heat the liquid and the ejection opening corresponding to the heating surface, by heating the liquid with the heating surface to produce a bubble communicating with air through the ejection opening such that at least a part of the heating surface is exposed to the air through the ejection opening, wherein the liquid is heated with the heating surface for 0.5 microseconds or shorter to produce a bubble communicating with the air through the ejection opening such that at least a part of the heating surface is exposed to the air through the ejection opening, in order to eject the liquid from the ejection opening.

14 Claims, 25 Drawing Sheets

| STANDARD DEVIATION OF EJECTION SPEED (m/s) | 0.24 | 0.30 | 0.34 | 0.40 | 0.44 | 0.50 | 0.56 | 0.64 | 0.74 |
|---|---|---|---|---|---|---|---|---|---|
| IMAGE QUALITY | ◎ | ◎ | ◎ | ◎ | ◎ | ○ | × | × | × |

LIQUID EJECTION METHOD, LIQUID EJECTION APPARATUS, AND LIQUID EJECTION HEAD

BACKGROUND OF THE INVENTION

Field of the Invention

The present disclosure relates to liquid ejection methods, liquid ejection apparatuses, and liquid ejection heads for ejecting various liquids including inks.

Description of the Related Art

In an inkjet printing apparatus configured to eject inks from ejection openings of a printing head to print images, small sub-droplets called satellite droplets can be produced together with main droplets of the inks ejected from the printing head. The satellite droplets can cause a decrease in the quality of printed images. Also, the satellite droplets adhere to an inner side of the printing apparatus and can cause a malfunction of the printing apparatus.

U.S. Patent Application Publication No. 2011/0205303 discusses a method in which the height of an ink channel and the depth of an ejection opening are set to prevent such satellite droplets. Specifically, the height of the ink channel is set to about 7.5 μm or less and the depth of the ejection opening to 10 μm or less.

However, it is newly found that ink ejections become unstable in the case in which the height of the ink channel and the depth of the ejection opening are reduced as discussed in U.S. Patent Application Publication No. 2011/0205303. Specifically, when an ejection operation is repeated a plurality of times to eject ink from the same ejection opening, the ink ejection speed varies among the ejection operations. It is found that the variation is likely to occur especially when the repetition period of the ejection operation is short, i.e., when the driving frequency of the printing head is high. Such an unstable ink ejection state leads to a decrease in quality of printed images.

On the other hand, when the repetition period of the ejection operation is increased, i.e., when the driving frequency of the printing head is reduced, the ink ejection state stabilizes, but the productivity of the printing apparatus decreases.

SUMMARY OF THE INVENTION

The present disclosure is directed to liquid ejection methods, liquid ejection apparatuses, and liquid ejection heads capable of ejecting liquids efficiently while a stable liquid ejection state is maintained.

According to an aspect of the present disclosure, a liquid ejection method includes ejecting liquid from an ejection opening, using liquid ejection head including a heating surface configured to heat the liquid and the ejection opening corresponding to the heating surface, by heating the liquid with the heating surface to produce a bubble communicating with air through the ejection opening such that at least a part of the heating surface is exposed to the air through the ejection opening, wherein the liquid is heated with the heating surface for 0.5 microseconds or shorter to produce a bubble communicating with the air through the ejection opening such that at least a part of the heating surface is exposed to the air through the ejection opening, in order to eject the liquid from the ejection opening.

Further features of the present disclosure will become apparent from the following description of exemplary embodiments with reference to the attached drawings.

DESCRIPTION OF THE EMBODIMENTS

Various exemplary embodiments of the disclosure will be described below with reference to the drawings. The exemplary embodiments described below are examples of application of the present disclosure to inkjet printing apparatuses (liquid ejection apparatuses) including a circulation path for circulating ink between an ink (liquid) tank and an inkjet printing head (liquid ejection head). However, the disclosure is not limited to the exemplary embodiments. For example, instead of circulating the ink, tanks can be respectively provided on upstream and downstream sides in the direction in which the ink is supplied in the printing head to move the ink from one of the tanks to the other tank so that the ink flows in a pressure chamber of the printing head.

Further, while the printing head according to the exemplary embodiments described below is a so-called line head having a length corresponding to the width of a printing medium, the disclosure is also applicable to a so-called serial printing head configured to eject ink while moving in a scan direction to print an image on a printing medium. Configuration examples of the serial printing head include a printing head including one element substrate for black ink and one element substrate for color ink. The configuration is not limited to the above-described configuration and, for example, the printing head can include a plurality of element substrates arranged along the direction of ejection opening arrays such that ejection openings of adjacent element substrates overlap each other. A line head including the element substrates arranged in this way to have a shorter length than the width of a printing medium can be configured and moved in scan direction.

Figure 1:
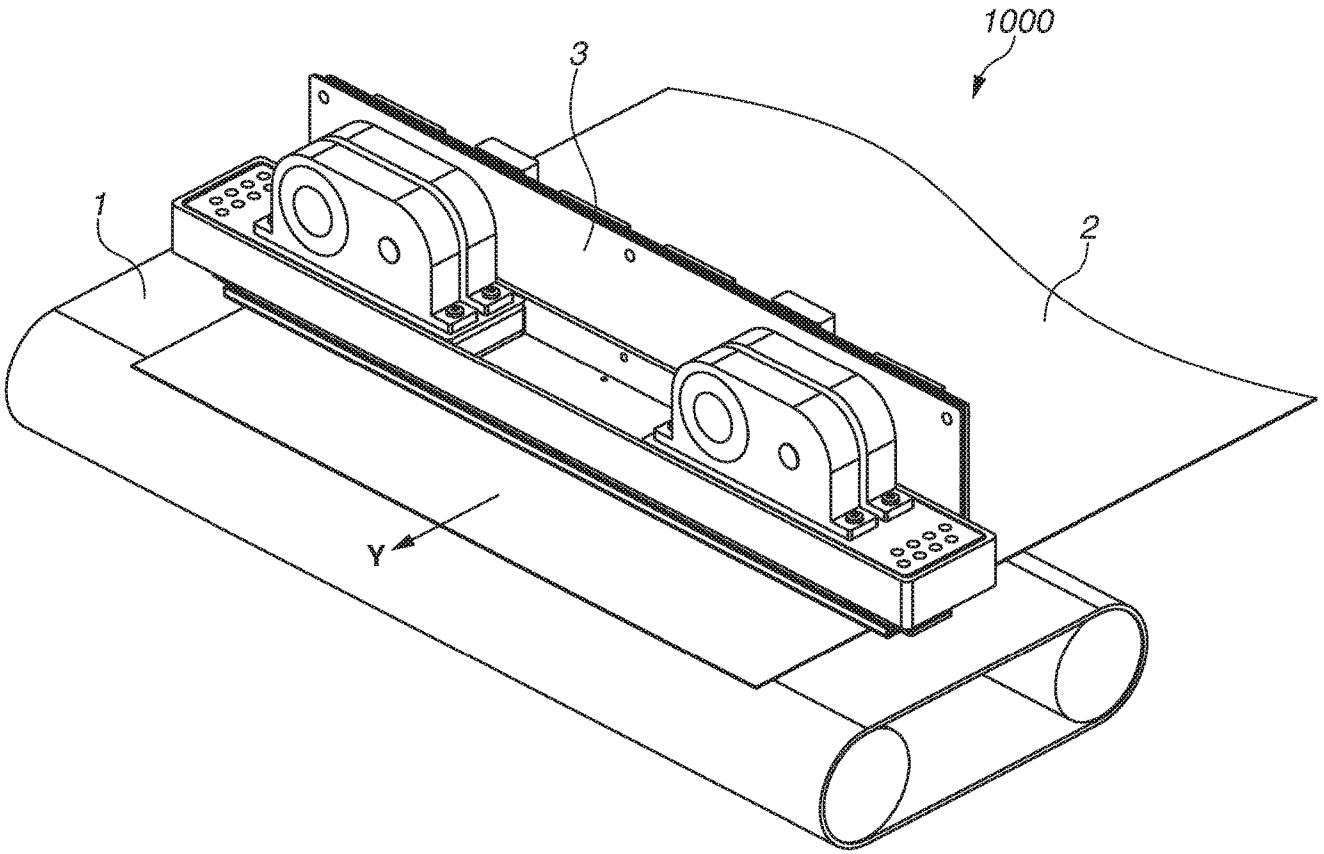
FIG. 1 is a perspective view illustrating a main part of a liquid ejection apparatus according to a first exemplary embodiment of the disclosure.

FIGS. 1 to 18F illustrate a first exemplary embodiment of the present disclosure. FIG. 1 schematically illustrates the configuration of an inkjet printing apparatus (liquid ejection apparatus) 1000 according to the present exemplary embodiment.

The printing apparatus 1000 is a line printing apparatus including a conveyance portion 1 and a line inkjet printing head (liquid ejection head) 3. The conveyance portion 1 conveys a print medium 2 in a conveyance direction specified by an arrow Y. The liquid ejection head 3 extends in a direction that intersects with the conveyance direction Y. In the present exemplary embodiment, it is the direction that is substantially orthogonal to the conveyance direction Y. The printing apparatus 1000 ejects ink (liquid) from the liquid ejection head (hereinafter, also referred to as "ejection head") 3 while continuously or intermittently conveying the print medium 2 to continuously print an image on the print medium 2. The print medium 2 is not limited to a cut sheet and can be a continuous roiled sheet. The ejection head 3 is capable of printing full-color images by ejecting cyan (C), magenta (M), yellow (Y), and black (K) inks from a plurality of ejection openings. As described below, the ejection head 3 is fluidically connected to an ink supply path including a main tank and a buffer tank and is electrically connected to a control unit configured to transmit power and control signals.

The ink supply path includes an ink circulation path, and a first or a second form of the circulation path is applicable. A first circulation path as the first form and a second circulation path as the second form will be separately described below.

(First Circulation Path)

Figure 2:
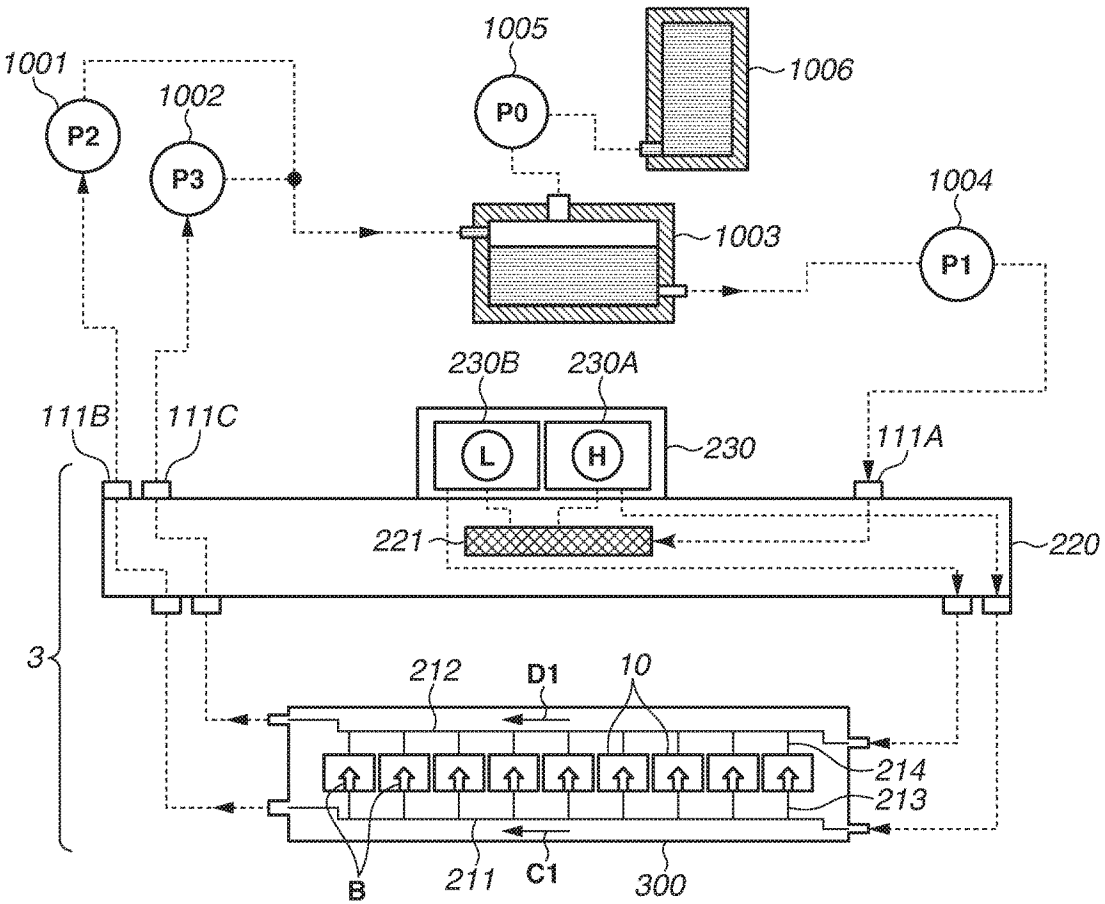
FIG. 2 illustrates a first form of a liquid circulation path.

FIG. 2 schematically illustrates the first circulation path, and the ejection head 3 is fluidically connected to a first circulation pump 1001 on a high-pressure side, a first circulation pump 1002 on a low-pressure side, a buffer tank 1003, etc. In FIG. 2, only the circulation path corresponding to one color ink is illustrated in order to simplify the description. Although not illustrated, the circulation paths for four C, N, Y, and K inks are connected to the ejection head 3. The buffer tank 1003 as a sub-tank can discharge bubbles contained in the inks to the outside through an air communication opening (not illustrated) for communication between the inside and the outside. The buffer tank 1003 is connected to a main tank 1006 via a replenishment pump 1005. The replenishment pump 1005 moves the ink consumed by the ejection head 3 from the main tank 1006 to the buffer tank 1003. The ejection head 3 consumes the ink in a printing operation in which the ink is ejected from the ejection openings, suction and recovery processing in which the ink is sucked and discharged from the ejection openings, etc.

The two first circulation pumps 1001 and 1002 suck the ink from connection portions 111B and 111C of the ejection head 3 and send the ink to the buffer tank 1003. The first circulation pumps 1001 and 1002 are desirably displacement pumps capable of quantitatively sending liquid. Specific examples include tube pumps, gear pumps, diaphragm pumps, and syringe pumps. For example, a commonly-used constant flow valve or a relief valve can be provided to an outlet of the pump to ensure a constant flow rate. When the ejection head 3 is driving, the first circulation pump 1001 on the high-pressure side and the first circulation pump 1002 on the low-pressure side cause a constant amount of ink to flow into a common supply channel 211 and a common collection channel 212 in a liquid ejection unit (hereinafter, also referred to as "ejection unit") 300 of the ejection head 3. The flow rate is set such that a difference in temperature between a plurality of element substrates 10 included in the ejection unit 300 is maintained within a predetermined range. Each of the element substrates 10 includes a plurality of ejection openings and an ejection energy generation element for ejecting ink from the ejection openings. Examples of the ejection energy generation element includes an electrothermal transduction element, such as a heater, and piezoelectric element. By the flow of the ink in the common supply channel 211 and the common collection channel 212, the element substrates 10 heated by heat generated by the ejection energy generation element are cooled so that the difference in temperature between the element substrates 10 is maintained within the predetermined range to an extent that the quality of printed images is not affected. If the ink flow rate in the common supply channel 211 and the common collection channel 212 is excessively high, a difference in ink negative pressure between the element substrates 10 can increase due to pressure drop in the common supply channel 211 and the common collection channel 212, and which results in a printed image with uneven density. Thus, the differences in temperature and negative pressure between the element substrates 10 are taken into consideration when the ink flow rate is set.

Between a second circulation pump 1004 and the ejection unit 300 of the ejection head 3, a negative pressure control unit 230 is provided. The negative pressurecontrol unit 230 functions such that if the ink flow rate in an ink circulation system is changed according to the printing task load, the ink pressure at the downstream side, i.e., an ejection unit 300 side, of the negative pressure control unit 230 is maintained at a preset constant pressure. Two negative pressure adjustment mechanisms 230A and 230B included in the negative pressure control unit 230 are configured to control the pressure at the downstream side of the negative pressure adjustment mechanisms 230A and 230B within a predetermined range with a desired set pressure being the center. For example, a mechanism that is similar to a so-called "pressure reduction regulator" can be employed. In the case of using the pressure reduction regulator, it is desirable to apply pressure on the ink located on the upstream side of the negative pressure control unit 230, using the second circulation pump 1004 connected to a connection portion 111A of a supply unit 220 included in the ejection head 3, as illustrated in FIG. 2. This configuration can reduce the hydraulic head pressure effect of the buffer tank 1003 on the ejection head 3 and can increase the degree of freedom in the layout of the buffer tank 1003 in the printing apparatus 1000. Between the connection portion 111A and the negative pressure control unit 230, a filter 221 is provided.

The second circulation pump 1004 can be any pump having a pump head pressure that is not lower than a predetermined pressure, within a range of an ink circulation flow rate used during the driving of the ejection head 3, and a turbo pump, displacement pump, etc. can be used. Specifically, a diaphragm pump or the like is applicable. Further, for example, a hydraulic head tank arranged with a predetermined hydraulic head difference with respect to the negative pressure control unit 230 is also applicable in place of the second circulation pump 1004.

Control pressures set to the two negative pressure adjustment mechanisms 230A and 230B of the negative pressure control unit 230 are different from each other. The negative pressure adjustment mechanism 230A to which a relatively high pressure is set is connected to the common supply channel 211 in the ejection unit 300 through the liquid supply unit (hereinafter, also referred to as "supply unit") 220. On the other hand, the negative pressure adjustment mechanism 230B to which a relatively low pressure is set is connected to the common collection channel 212 in the ejection unit 300 through the supply unit 220. The ejection unit 300 includes separate supply channels 213 and separate collection channels 214 through which the common supply channel 211 and the common collection channel 212 communicate through the element substrates 10. Specifically, the separate supply channels 213 are provided for communication between the common supply channel 211 and the element substrates 10, and the separate collection channels 214 are provided for communication between the common collection channel 212 and the element substrates 10. The common supply channel 211 is connected to the negative pressure adjustment mechanism 230A on the high-pressure side, and the common collection channel 212 is connected to the negative pressure adjustment mechanism 230B on the low-pressure side, so a difference in pressure occurs between the common supply channel 211 and the common collection channel 212. Accordingly, the ink in the common supply channel 211 passes through internal channels of the element substrates and flows into the common collection channel 212, as specified by arrows B in FIG. 2.

In the ejection unit 300, while the ink flows in the common supply channel 211 and the common collection channel 212 in the directions of arrows C1 and D1, some of the ink flows in the element substrates 10 in the direction of the arrows B. This flow of ink can discharge heat generated in the element substrates 10 to the outside. Further, the above-described configuration causes a flow of ink also in the ejection openings that eject no ink and in pressure chambers that communicate with the ejection openings during the printing operation in which the ejection head 3 ejects the ink. As a result, this can prevent an increase in viscosity of the ink in the ejection openings and the pressure chambers. Further, the flow of ink discharges thickened ink and foreign matter contained in the ink to the common collection channel 212. In this way, the ejection head 3 prints high-quality images at high speed.

(Second Circulation Path)

Figure 3:
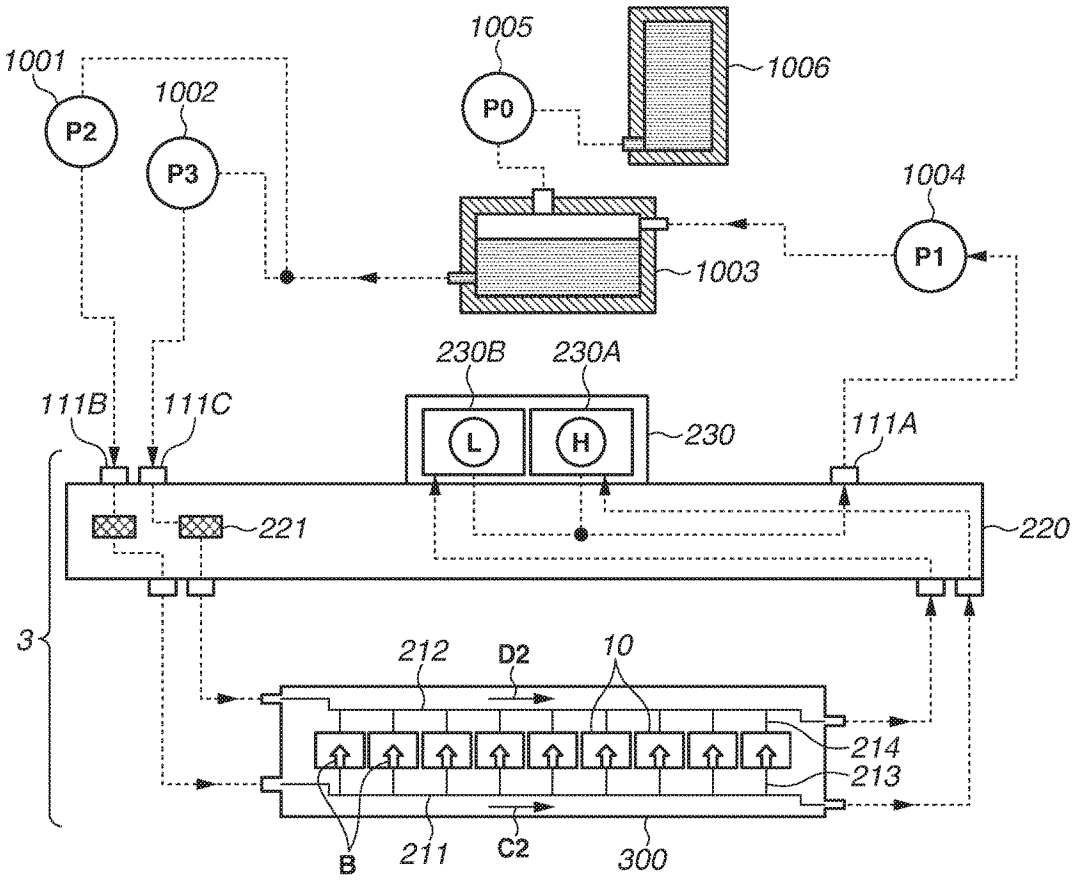
FIG. 3 illustrates a second form of the liquid circulation path.

FIG. 3 schematically illustrates the second circulation path, which is in a different form from the first circulation path. In the second circulation path, the two negative pressure adjustment mechanisms 230A and 230B of the negative pressure control unit 230 control the pressure at the upstream side of the negative pressure adjustment mechanisms 230A and 230B within the predetermined range with the desired set pressure being the center. Thus, the negative pressure adjustment mechanisms 230A and 230B can employ a similar configuration to a so-called "back pressure regulator". Further, the second circulation pump 1004 acts as a negative pressure source which reduces the pressure on the downstream side of the negative pressure control unit 230. Further, the first circulation pump 1001 on the high-pressure side and the first circulation pump 1002 on the low-pressure side are placed on the upstream side of the ejection head 3, and the negative pressure control unit 230 is provided on the downstream side of the ejection head 3.

The negative pressure control unit 230 on the second circulation path functions such that if the ink flow rate in the ink circulation system is changed according to the printing task load, the ink pressure at the upstream side, i.e., the ejection unit 300 side, of the negative pressure control unit 230 is maintained at a preset constant pressure. It is desirable to apply pressure to the downstream side of the negative pressure control unit 230 through the supply unit 220, using the second circulation pump 1004, as illustrated in FIG. 3. This configuration can reduce the hydraulic head pressure effect of the buffer tank 1003 on the ejection head 3 and increase the degree of freedom in the layout of the buffer tank 1003 in the printing apparatus 1000. Further, for example, a hydraulic head tank arranged with a predetermined hydraulic head difference with respect to the negative pressure control unit 230 is also applicable in place of the second circulation pump 1004.

As in the first circulation path, control pressures set to the two negative pressure adjustment mechanisms 230A and 230B of the negative pressure control unit 230 are different from each other. The negative pressure adjustment mechanism 230A to which a relatively high pressure is set is connected to the common supply channel 211 in the ejection unit 300 through the supply unit 220. On the other hand, the negative pressure adjustment mechanism 230B to which a relatively low pressure is set is connected to the common collection channel 212 in the ejection unit 300 through the supply unit 220. With the negative pressure adjustment mechanisms 230A and 230B, the pressure of the common supply channel 211 is set higher than the pressure of the common collection channel 212. In this way, in the ejection unit 300, while the ink flows in the common supply channel 211 and the common collection channel 212 in the directions of arrows C2 and D2, some of the ink flows in the element substrates 10 in the direction of the arrows B.

(Comparison between First and Second Circulation Paths)

In the second circulation path, the flow of ink which is similar to the flow of ink in the first circulation path occurs in the ejection unit 300. However, the second circulation path has two different advantages from the first circulation path.

The first advantage is that since the negative pressure control unit 230 is provided on the downstream side of the ejection head 3 in the second circulation path, wastes and foreign matter from the negative pressure control unit 230 are less likely to flow into the ejection head 3. The second advantage is that in the second circulation path, a maximum value of the flow rate of ink that needs to be supplied from the buffer tank 1003 to the ejection head 3 can be smaller than that in the case of the first circulation path. The reason is as follows.

A flow rate A, which is a total flow rate of ink that flows in the common supply channel 211 and the common collection channel 212 in a case in which the ink is circulated during a printing operation standby time (printing standby time), is defined as a minimum ink flow rate that is needed to maintain the difference in temperatures in the ejection unit 300 within a desired range in a case of performing temperature adjustment on the ejection head 3 during the printing standby time. Further, an ink ejection amount F is defined as the amount of ink that is ejected in a case of ejecting the ink from all the ejection openings of the ejection unit 300 (all-ejection time). In the case of the first circulation path illustrated in FIG. 2, the set ink flow rate in the first circulation pump 1001 on the high-pressure side and the first circulation pump 1002 on the low-pressure side is the flow rate A, so the maximum value of the amount of ink that needs to be supplied to the ejection head 3 during the all-ejection time is (A+F).

On the other hand, in the case of the second circulation path in FIG. 3, the amount of ink that needs to be supplied to the ejection head 3 during the printing standby time is the amount A, and the maximum value of the amount of ink that needs to be supplied to the ejection head 3 during the all-ejection time is the ink ejection amount F. In the second circulation path, the total value of the set ink flow rate in the first circulation pump 1001 on the high-pressure side and the first circulation pump 1002 on the low-pressure side, i.e., the maximum value of the flow rate of ink that needs to be supplied, is the larger one of the amounts A and F. Thus, when the ejection unit 300 of the same configuration is used, the maximum value (A or F) of the amount of ink that needs to be supplied in the second circulation path is smaller than the maximum value (A+F) of the flow rate of ink that needs to be supplied in the first circulation path. This provides wider range of choices of applicable circulation pumps in the case of the second circulation path. Consequently, for example, low-cost circulation pump having a simple configuration can be used and the load on a cooling device (not illustrated) provided to the ink channel on the main body side of the printing apparatus can be reduced. In the case of the second circulation path, the costs of the main body of the printing apparatus therefore can be reduced. The advantage becomes more significant as the flow rate A of the ink or F of the line ejection head (line head) is increased or as the length of the line head in a longer side direction is increased.

However, the first circulation path is more advantageous than the second circulation path in some points. Specifically, in the second circulation path, since the flow rate of ink flowing in the ejection unit 300 during the printing standby time is the maximum, a high negative ink pressure applied to a nozzle having channels including ejection openings, as the printing task load is lowered. Especially when the channel width, which is a length in a direction that is orthogonal to the direction in which the ink flows, of the common supply channel 211 and the common collection channel 212 is reduced to the width, which is a length of the ejection head in a shorter side direction, of the ejection head 3, the high negative ink pressure is applied to the nozzle. Since the high negative ink pressure is applied to the nozzle during the printing of an image that is likely to have uneven density due to low printing task load, satellite droplets (sub-droplets), which decrease the quality of printed images, are likely to be produced together with main droplets of the ink from the nozzle. On the other hand, in the first circulation path, the high negative ink pressure is applied to the nozzle during the printing of an image with high printing task load, so even if satellite droplets are produced at the high printing task load, the satellite droplets are less visible and have no significant effect on the image. A desirable one of the first and second circulation paths can be selected based on the specifications, such as an ink ejection amount F, a minimum circulation flow rate A, and channel resistance in the ejection head, of the ejection head 3 and the main body of the printing apparatus.

(Configuration of Ejection Head)

Figure 4A:
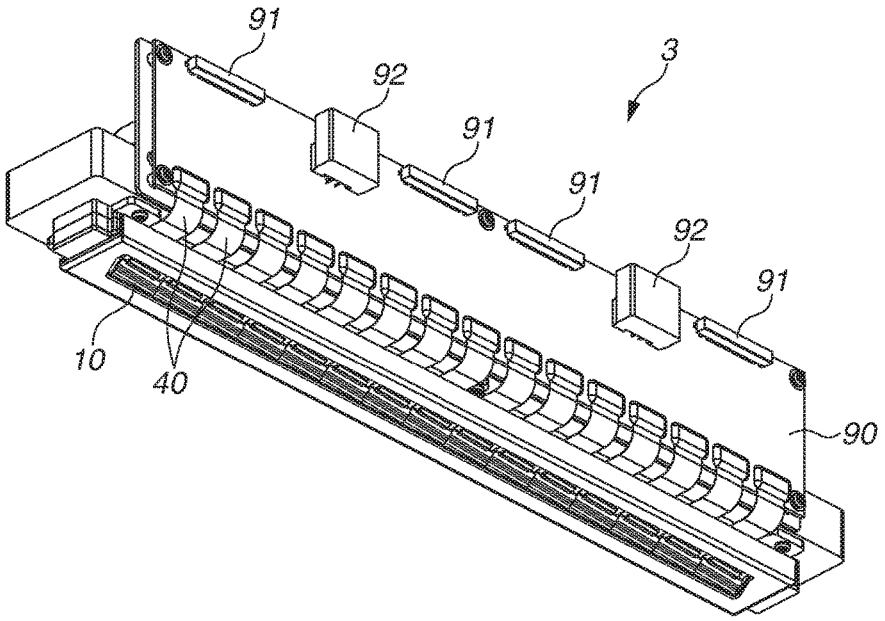
FIGS. 4A and 4B are perspective views each illustrating a liquid ejection head illustrated in FIG. 1.
Figure 4B:
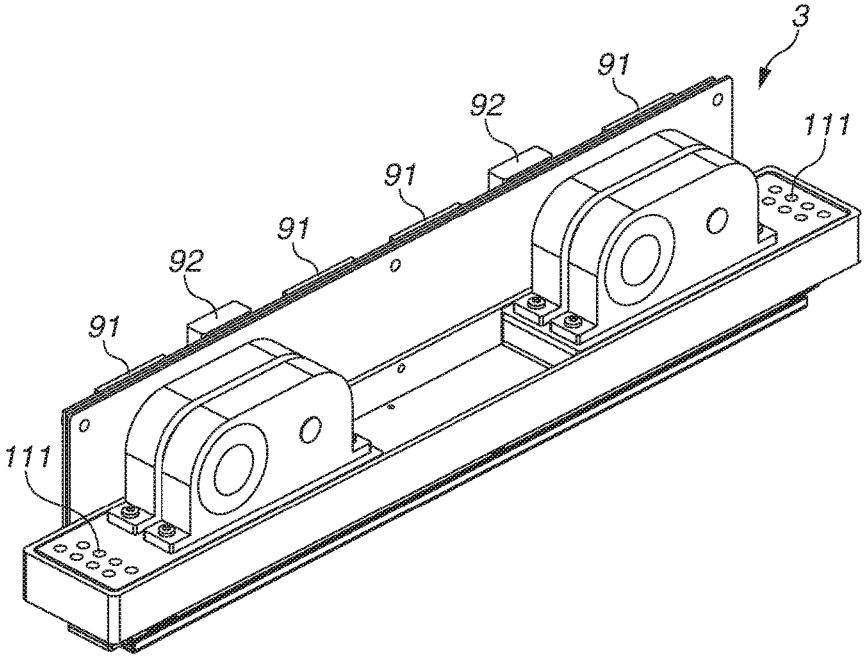

FIGS. 4A and 4B are perspective views illustrating the ejection head 3 according to the present exemplary embodiment. In each of the element substrates 10, the plurality of ejection openings from which the four color inks of C, M, Y, and K can be ejected is arranged, and 15 pieces of the element substrates 10 are aligned in a straight line (in-line arrangement), forming the ejection head 3 of a line type. As illustrated in FIG. 4A, each of the element substrates 10 is electrically connected to a signal input terminal 91 and a power supply terminal 92 via a flexible wiring substrate 40 and an electric wiring substrate 90. The signal input terminal 91 and the power supply terminal 92 are electrically connected to the control unit of the printing apparatus 1000 and supply to the element substrates 10 ejection driving signals and power that is necessary to eject ink. The wiring is aggregated by an electric circuit in the electric wiring substrate 90 so that the number of the signal input terminals 91 and the power supply terminals 92 is reduced to be smaller than the number of the element substrates 10. This decreases the number of electric connection portions that need to be detached to attach the ejection head 3 to the printing apparatus 1000 or replace the ejection head 3. As illustrated in FIG. 4B, the connection portion 111 (including the connection portions 111A, 111B, and 111C) provided in each of the end portions of the ejection head 3 is connected to an ink supply system of the printing apparatus 1000 as illustrated in FIG. 2 or 3. As described above, the four color inks of C, M, Y, and K are supplied from the printing apparatus 1000 to the ejection head 3, and the inks passed through the ejection head 3 are collected into the printing apparatus 1000. In this way, the inks of the respective colors are circulated through the paths in the printing apparatus 1000 and the ejection head 3.

Figure 5:
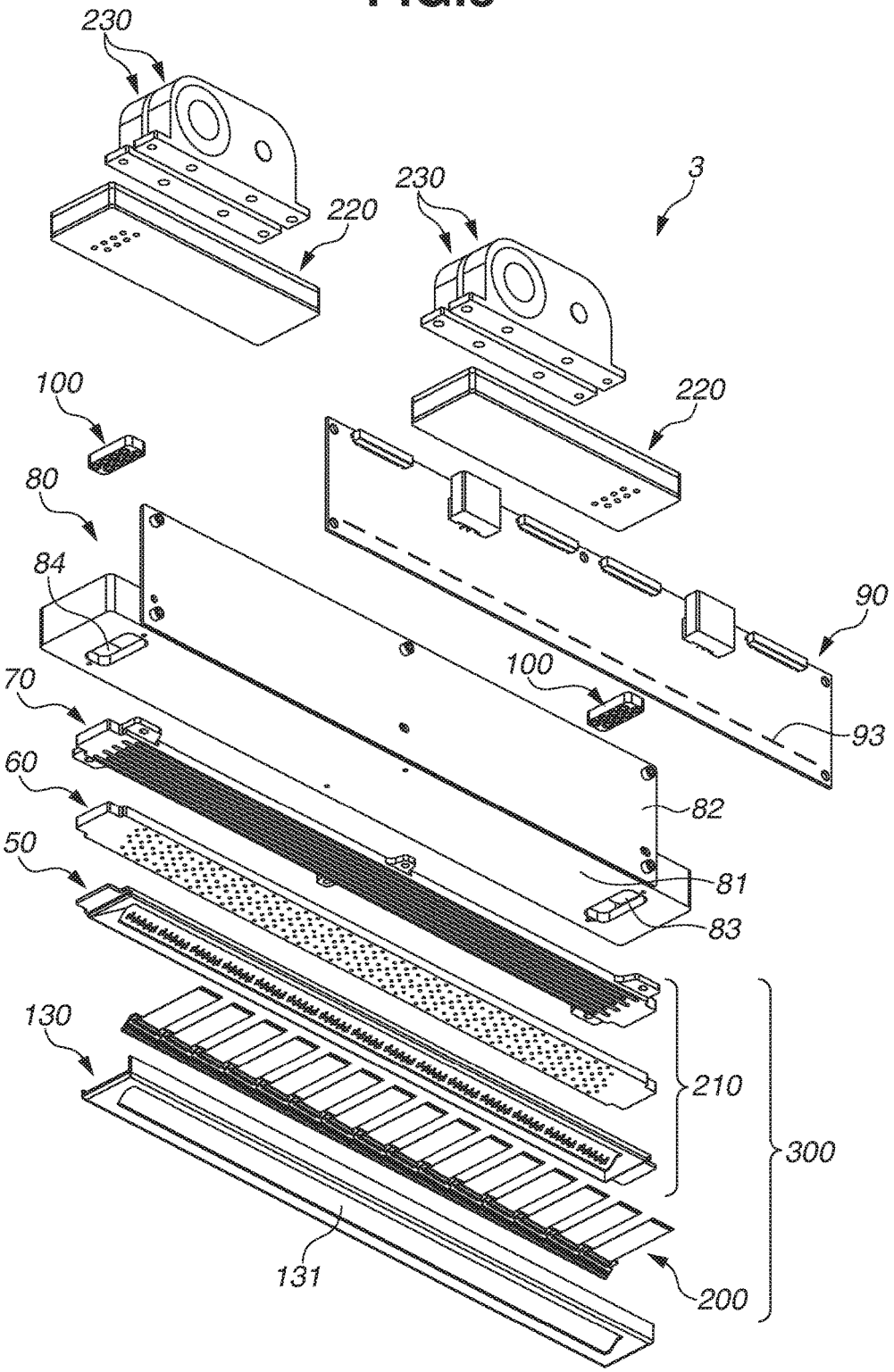
FIG. 5 is an exploded perspective view illustrating the liquid ejection head illustrated in FIG. 1.

FIG. 5 is an exploded perspective view illustrating the ejection head 3. The ejection unit 300, the two supply units 220, and the electric wiring substrate are attached to a housing 80. The supply unit 220 includes the connection portions 111, and the filter 221 (refer to FIGS. 2 and 3) for eliminating foreign matter contained in the supplied inks is provided for each ink color in the supply unit 220. Each of the two supply units 220 includes the filters 221 corresponding to two ink colors. Each of the inks of the respective colors having passed through the filter 221 is supplied to the negative pressure control unit 230 placed on the corresponding supply unit 220. Four pieces of the negative pressure control units 230 are provided to correspond to the respective ink colors. The negative pressure control unit 230 is a unit including a pressure adjustment valve and significantly attenuates a change in pressure loss in the ink supply system of the printing apparatus 1000 that occurs in response to a change in the ink flow rate, using a valve and spring member provided in the negative pressure control unit 230. In this way, for example, in the first circulation path illustrated in FIG. 2, the change in pressure loss in the ink supply system on the upstream side of the ejection head 3 is attenuated so that a change in negative ink pressure on the downstream side, i.e., the ejection unit 300 side, of the negative pressure control unit 230 is stabilized within a predetermined range. In the negative pressure control unit 730, the two negative pressure adjustment mechanisms 230A and 230B are built in, and the negative pressure adjustment mechanism 230A on the high-pressure side is connected to the common supply channel 211 via the supply unit 220. Further, the negative pressure adjustment mechanism 230B on the low-pressure side is connected to the common collection channel 212 via the supply unit 220.

The housing 80 includes an ejection unit support portion 81 and an electric wiring substrate support portion 82, which support the ejection unit 300 and the electric wiring substrate 90, respectively, and provide stiffness to the ejection head 3. The electric wiring substrate support portion 82 is screwed to the ejection unit support portion 81. The ejection unit support portion 81 corrects a warped or deformed portion of the ejection unit 300 so that relative positional accuracy of the plurality of element substrates 10 is ensured. This prevents streaks on printed images and density unevenness. The ejection unit support portion 81 desirably has sufficient stiffness and is made of a metal material, such as stainless steel (SUS) and aluminum, or ceramics, such as alumina. The ejection unit support portion 81 includes openings 83 and 84 into which joint rubbers 100 are inserted. The inks supplied from the supply unit 220 are guided through channels in the joint rubbers 100 to a third channel member 70 of the ejection unit 300.

The ejection unit 300 includes a plurality of ejection modules 200 and a channel member 210, and a cover member 130 is attached to a surface of the ejection unit 300 that faces the print medium 2. As illustrated in FIG. 5, the cover member 130 is a frame-shaped member including an opening 131 which is extended long, and the element substrates 10 and sealing members 110 (refer to FIGS. 9A and 9B) of the ejection modules 200 are exposed from the opening 131. A frame portion around the opening 131 forms a contact surface that comes into contact with a cap member configured to cap the ejection head 3 during the printing standby time. Thus, a closed space can suitably be formed inside the cap member capping the ejection head 3 by applying an adhesive agent, sealing member, filler, etc. around the opening 131 to fill uneven portions and spaces in an ejection opening surface (surface in which the ejection openings are formed) of the ejection unit 300.

The channel member 210 includes a first channel member 50, a second channel member 60, and a third channel member 70 layered on top of another. The channel member 210 distributes the inks supplied from the supply unit 220 to the ejection modules 200 and returns the inks flowing back from the ejection modules 200 to the supply unit 220. The channel member 210 is screwed to the ejection unit support portion 81 to prevent warpage and deformation.

Figure 6A:
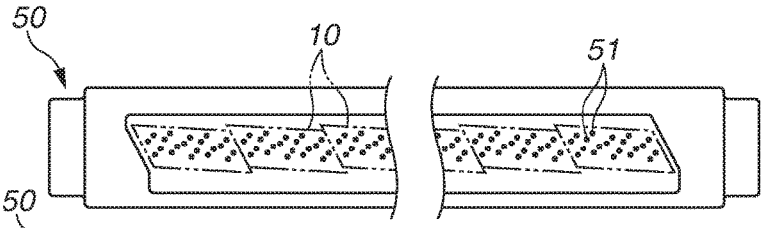
FIGS. 6A to 6F illustrate channel members illustrated in FIG. 5.
Figure 6B:
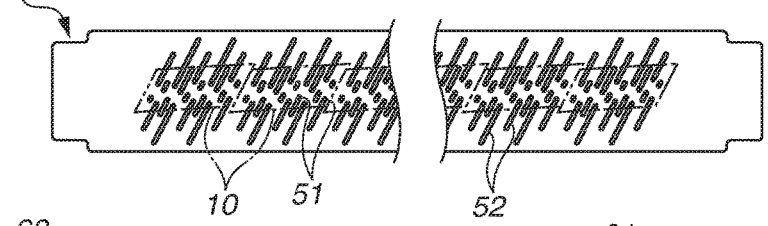
Figure 6C:
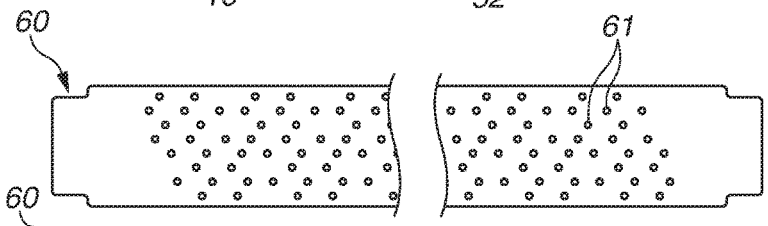
Figure 6D:
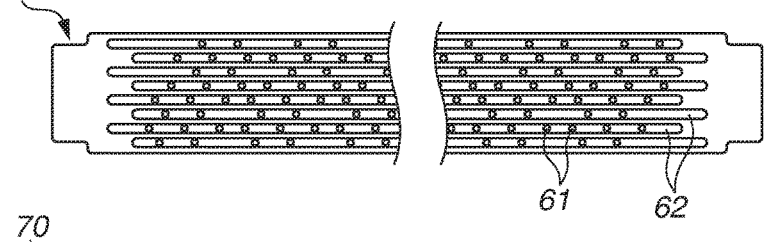
Figure 6E:
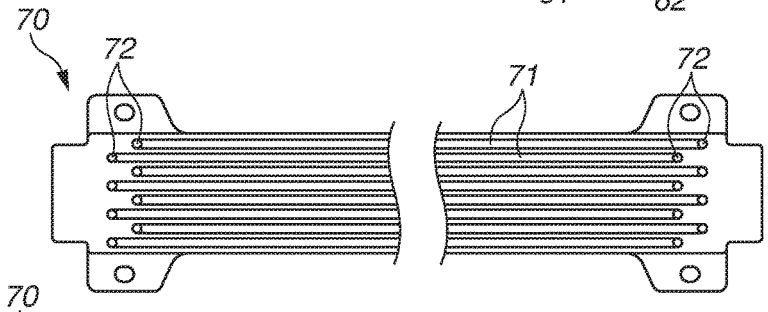
Figure 6F:
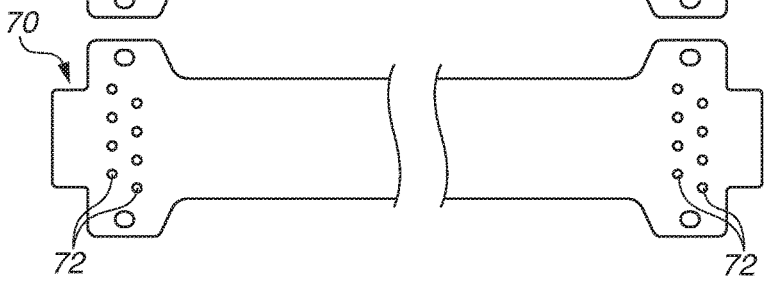

FIGS. 6A to 6F illustrate the first, second, and third channel members 0, 60, and 70 of the channel member 210. FIGS. 6A and 6B illustrate a lower surface, which is a surface on which the ejection modules 200 are to be placed, and an upper surface of the first channel member 50 illustrated in FIG. 5, respectively. Further, FIGS. 6C and 6D illustrate lower and upper surfaces of the second channel member 60 illustrated in FIG. 5, respectively. Further, FIG. 6E illustrates a lower surface of the third channel member 70 illustrated in FIG. 5, and FIG. 6F illustrates an upper surface, which is a surface that comes into contact with the ejection unit support portion 81, of the third channel member 70 illustrated in FIG. 5. The first and second channel members 50 and 60 are joined together such that the surfaces illustrated in FIGS. 6B and 6C face each other, and the second and third channel members 60 and 70 are joined together such that the surfaces illustrated in FIGS. 6D and 6E face each other.

When the second and third channel members 60 and 70 are joined together, common channel grooves 62 and 71 formed in the joined surfaces of the second and third channel members 60 and 70 form eight common channels extending along a longer side direction of the channel member 210. As described below, the eight common channels form the common supply channel 211 and the common collection channel 212 for each color. Communication openings 72 of the third channel member 70 fluidically communicate with the supply unit 220 through the channels in the joint rubbers 100. Bottom surfaces of the common channel grooves 62 of the second channel member 60 include a plurality of communication openings 61, each of which communicates with one end portion of separate channel grooves 52 of the first channel member 50, as illustrated in FIG. 6C. The other end portion of each of the separate channel grooves 52 of the first channel member 50 includes a communication opening 51 as illustrated in FIG. 6A, and the separate channel grooves 52 fluidically communicate with the plurality of ejection modules 200 through the communication openings 51. The separate channel grooves 52 allows the channels to arranged in a central portion of the channel member 210.

Desirably, the first, second, and third channel members 50, 60, and 70 are made of a material having corrosion resistance with respect to the inks and having a low linear expansion coefficient. Examples of such a material include alumina and a composite material (resin material). Examples of a suitable composite material for use include a composite material prepared by adding an inorganic filler, such as silica particulates or fibers, to a liquid crystal polymer (LOP), polyphenylene sulfide (PPS), or polysulfone (PSF) as a base material. The channel member 210 can be formed by a method in which the three channel members, i.e., the first, second, and third channel members 50, 60, and 70, are layered and bonded together. In the case in which a resin composite or resin material is used as the material, welding can be used as a joining method.

Figure 7:
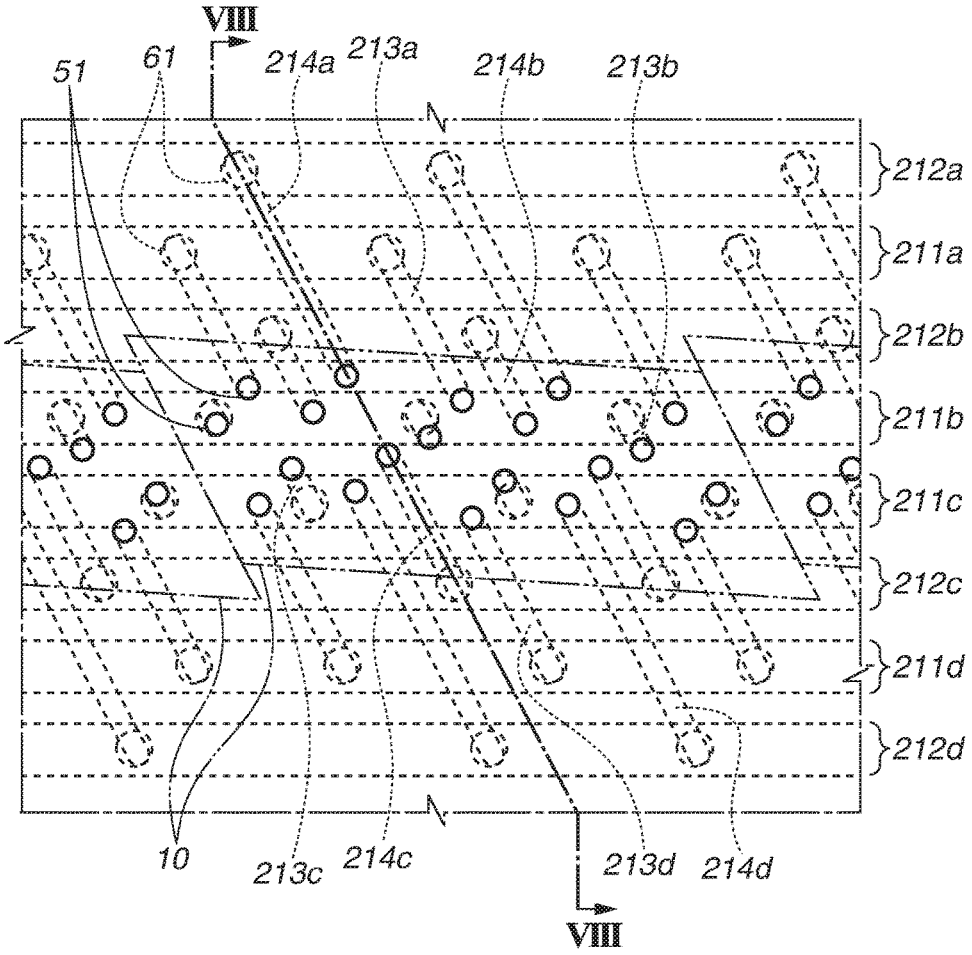
FIG. 7 illustrates channels formed by the channel members.

FIG. 7 is an enlarged perspective view of a portion of the channels in the channel member 210 formed by joining the first, second, and third channel members 50, 60, and 70 together, viewed from the lower side (side of the surface on which the ejection modules 200 are to be placed) of the first channel member 50 illustrated in FIG. 5.

The channel member 210 includes the common supply channels 211 (211*a*, 211*b*, 211*c*, 211*d*) and the common collection channels 212 (212*a*, 212*b*, 212*c*, 212*d*), each corresponding to a different ink color, extending along a longer side direction of the ejection head 3. The common supply channels 211 each corresponding to a different ink color are connected to the plurality of separate supply channels 213 (213*a*, 213*b*, 213*c*, 213*d*) formed by the separate channel grooves 52 through the communication openings 61. Further, the common collection channels 212 each corresponding to a different ink color are connected to the plurality of separate collection channels 214 (214*a*, 214*b*, 214*c*, 214*d*) formed by the separate channel grooves 52 through the communication openings 61. This channel configuration can supply the inks from the common supply channels 211 each corresponding to a different ink color through the separate supply channels 213 to the element substrates 10 situated in the central portion of the channel member 210. Further, the inks can be collected from the element substrates 10 through the separate collection channels 214 to the common collection channels 212.

Figure 8:
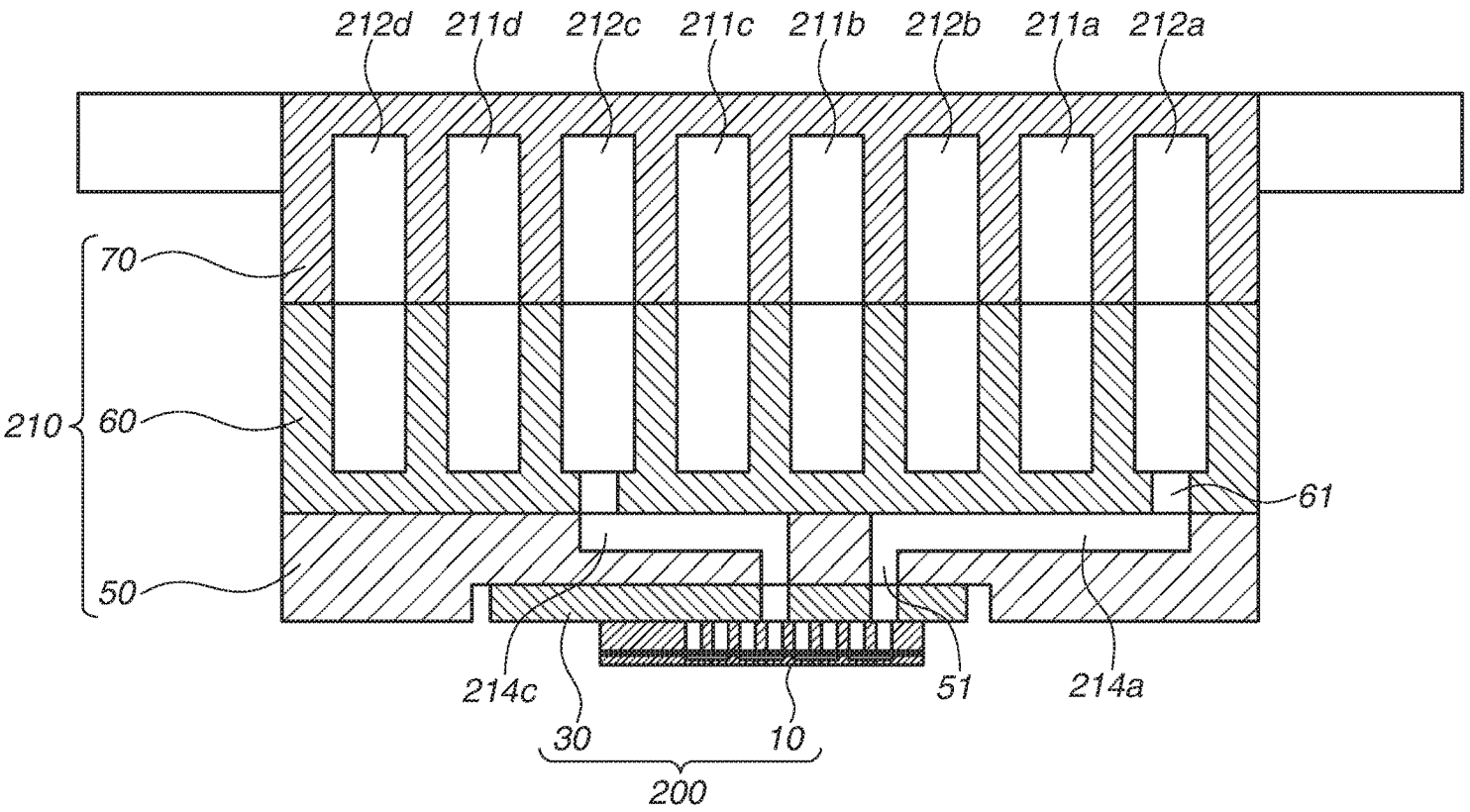
FIG. 8 is a cross-sectional view of the channel member taken along line VIII-VIII specified in FIG. 7.

FIG. 8 is a cross-sectional view taken along line VIII-VIII specified in FIG. 7. In FIG. 8, the separate collection channels 214*a* and 214*c* communicate with the ejection module 200 through the communication openings 51. While the cross-sectional view in FIG. 8 illustrates only the separate collection channels 214*a* and 214*c*, the separate supply channels 213 communicating with the ejection module 200 through the communication openings 51 are in another cross-sectional view. A support member 30 and the element substrate 10 of the ejection module 200 include a channel for supplying the inks supplied from the first channel member 50 into a pressure chamber 23 (refer to FIG. 11A) of the element substrate 10. Further, the support member 30 and the element substrate 10 include a channel for collecting (circulating) some or all of the inks supplied into the pressure chamber 23 to the first channel member 50.

The common supply channels 211 each corresponding to a different ink color are connected to the negative pressure adjustment mechanism 230A on the high-pressure side of the corresponding negative pressure control unit 230 via the supply unit 220. Further, the common collection channels 212 each corresponding to a different ink color are connected to the negative pressure adjustment mechanism 230B on the low-pressure side of the corresponding negative pressure control unit 230 via the supply unit 220. The negative pressure control unit 230 causes a difference in pressure (pressure difference) between the common supply channel 211 and the common collection channel 212, as described above. This channel configuration enables each of the inks to flow from the common supply channels 211 to the separate supply channels 213, the element substrates 10, the separate collection channels 214, and the common collection channels 212 in this order.

(Ejection Module)

Figure 9A:
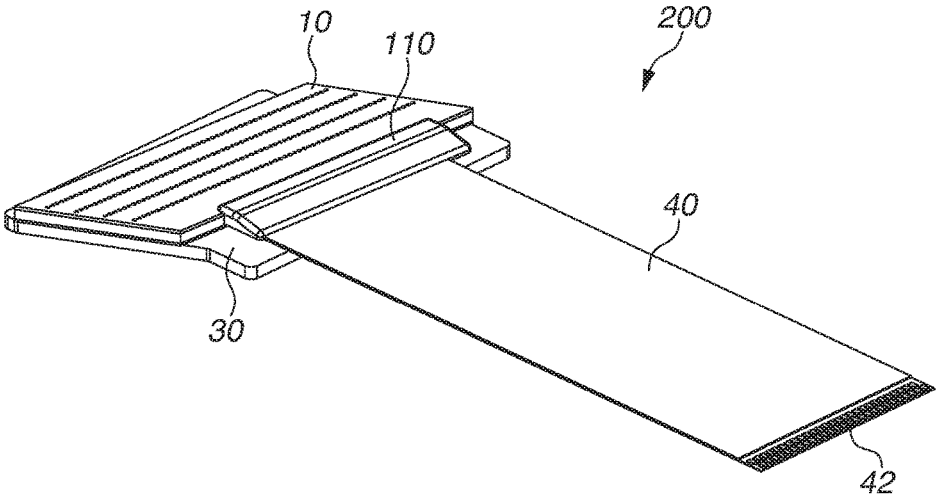
FIGS. 9A and 9B are perspective views each illustrating an element substrate illustrated in FIG. 8.
Figure 9B:
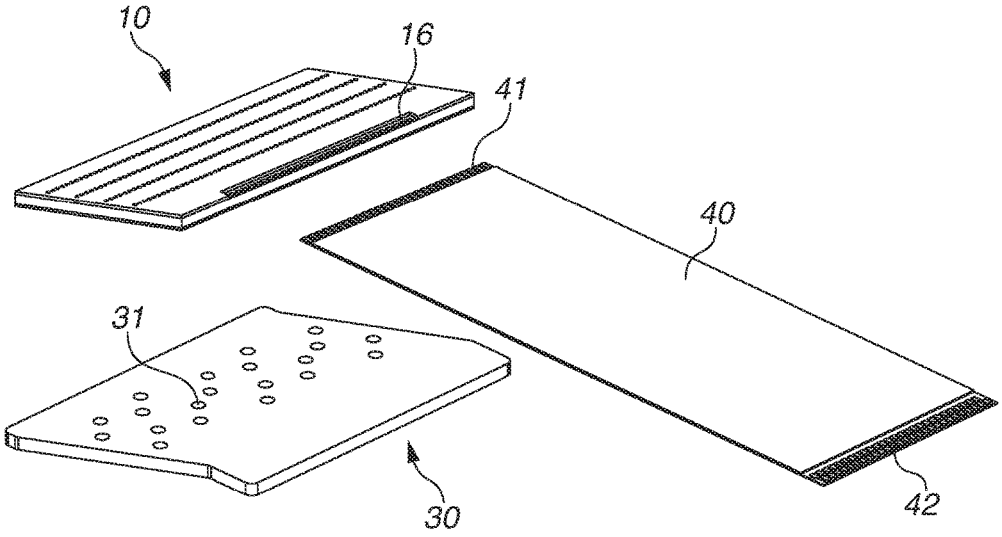

FIG. 9A is a perspective view illustrating one of the ejection modules 200, and FIG. 9B is an exploded view of the ejection module 200. In the production of the ejection module 200, first, the element substrate 10 and the flexible wiring substrate 40 described below are bonded on the support member 30 in which liquid communication openings 31 are formed in advance. Then, a terminal 16 on the element substrate 10 and a terminal 41 on the flexible wiring substrate 40 are electrically connected together by wire bonding, and the wire bonded portion (electrically connected portion) is covered and sealed with the sealing member 110. A terminal 42 located on the opposite side to the terminal 41 on the flexible wiring substrate 40 is electrically connected to a connection terminal 93 (refer to FIG. 5) of the electric wiring substrate 90 The support member 30 is a support member configured to support the element substrates 10 and also a channel member through which the element substrate 10 and the channel member 210 fluidically communicate with each other, so the support member 30 is desirably a member that has high flatness and can be joined with the element substrate 10 with high degree of reliability. Examples of suitable materials of the support member 30 include alumina and resin materials.

(Element Substrate)

Figure 10:
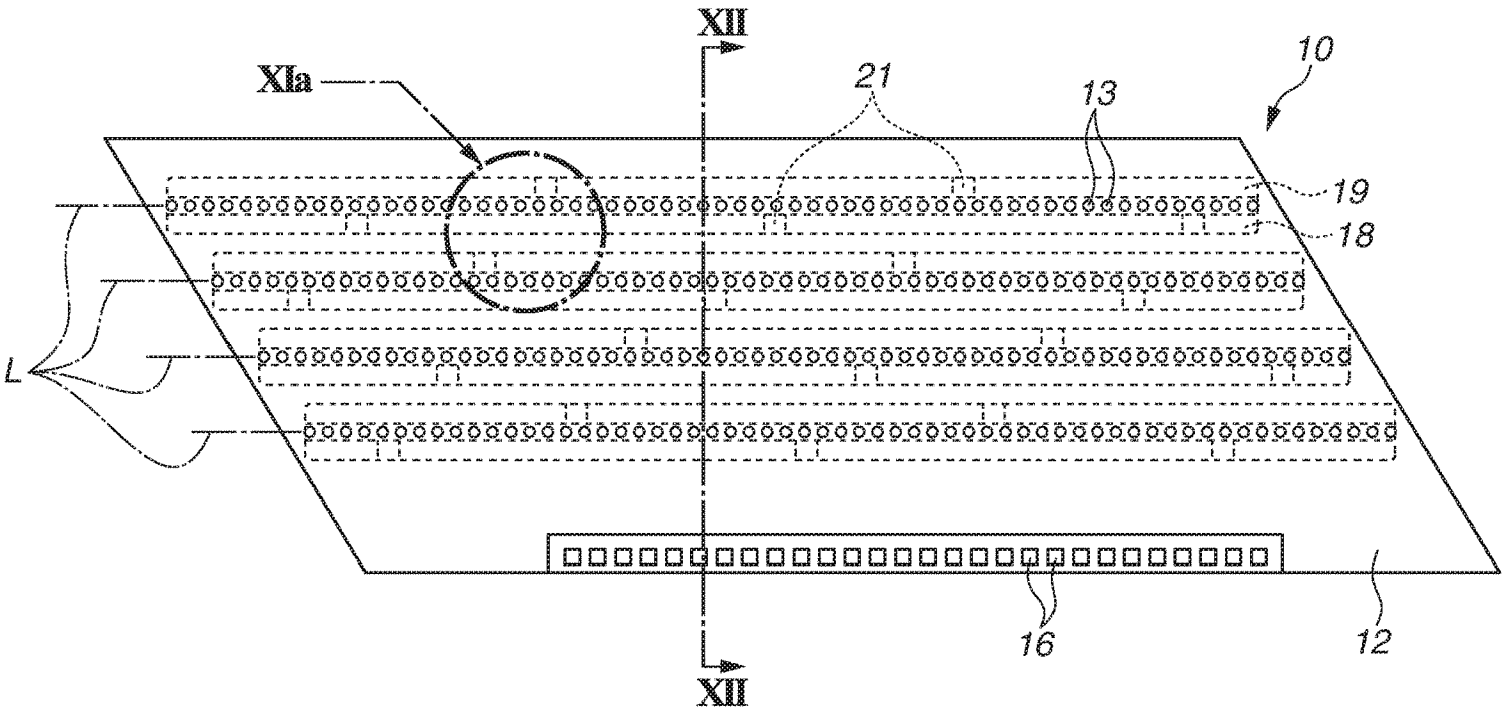
FIG. 10 is a plan view illustrating the element substrate.
Figure 11A:
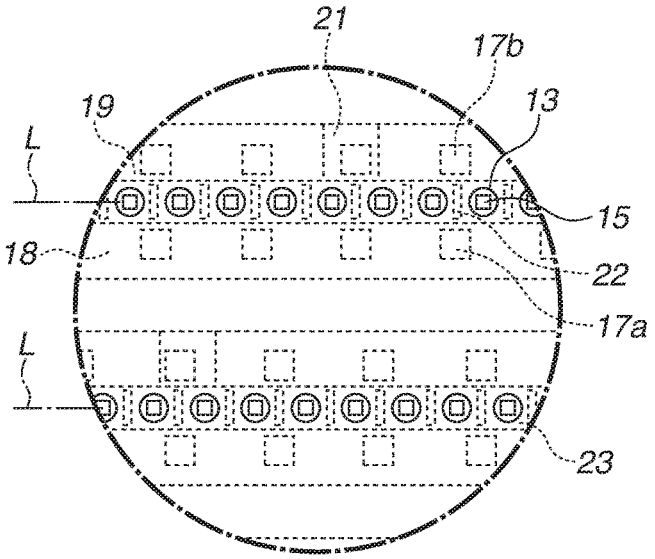
FIG. 11A is an enlarged view illustrating a portion XIa specified in FIG. 10.
Figure 11B:
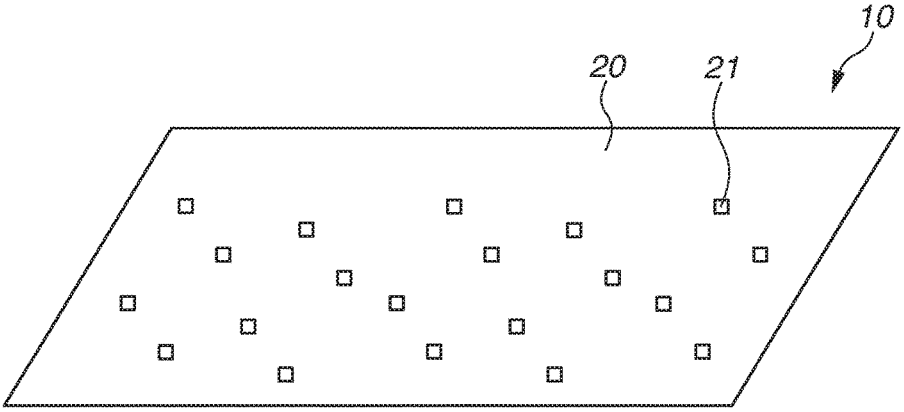
FIG. 11B is a detailed bottom view illustrating the element substrate.

FIG. 10 is a plan view illustrating the element substrate 10 viewed from the ejection opening 13 side. FIG. 11A is an enlarged view illustrating a portion XIa specified in FIG. 10. FIG. 11B illustrates the element substrate 10 viewed from the opposite side to the ejection opening 13 side. As illustrated in FIG. 10, an ejection opening formed member 12 of the element substrate 10 includes the plurality of ejection openings 13, and the ejection openings 13 form four ejection opening arrays L each corresponding to a different ink color. Hereinafter, the direction in which the ejection opening arrays L of the plurality of ejection openings 13 extend is sometimes referred to as an "ejection opening array direction".

In each of the positions corresponding to the ejection openings 13, an ejection energy generation element, such as an electrothermal transduction element (heat generation element, such as a heater) or piezoelectric element, is provided to eject the inks. In the present exemplary embodiment, a heat generation element 15 is provided as the ejection energy generation element and functions as a printing element for printing an image with the inks. The heat generation element 15 is provided to a substrate 11 (refer to FIG. 14B) of the element substrate 10 and forms a heating surface for heating the inks. In the element substrate 10, the pressure chambers 23 each including the heat generation element 15 are compartmented by channel walls 22. The heat generation elements 15 are electrically connected to the terminals 16 illustrated in FIG. 10 by electric wiring (not illustrated) provided to the element substrate 10. The heat generation elements 15 generate heat to cause the inks to bubble based on a pulse signal input from a control circuit of the printing apparatus 1000 via the electric wiring substrate 90 (refer to FIG. 5) and the flexible wiring substrate 40 (refer to FIGS. 9A and 9B). The bubble generating energy causes the inks to be ejected from the ejection openings 13. As illustrated in FIG. 11A, a supply path 18 is formed on one side of the ejection opening array L and a collection path 19 is formed on the other side along the ejection opening array L. The supply path 18 and the collection path 19 communicate with the ejection openings 13 through supply openings 17*a* and collection openings 17*b*, respectively.

As illustrated in FIG. 11B, a cover member 20 having a sheet shape is layered on a surface of the element substrate 10 that is opposite to the surface including the ejection openings 13, and the cover member 20 includes a plurality of openings 21 communicating with the supply path 18 and the collection path 19. In the present exemplary embodiment, the cover member 20 includes three openings 21 with respect to one supply path 18 and two openings 21 with respect to one collection path 19. The openings 21 communicate with the corresponding communication openings 51 as illustrated in FIG. 6A.

Figure 12:
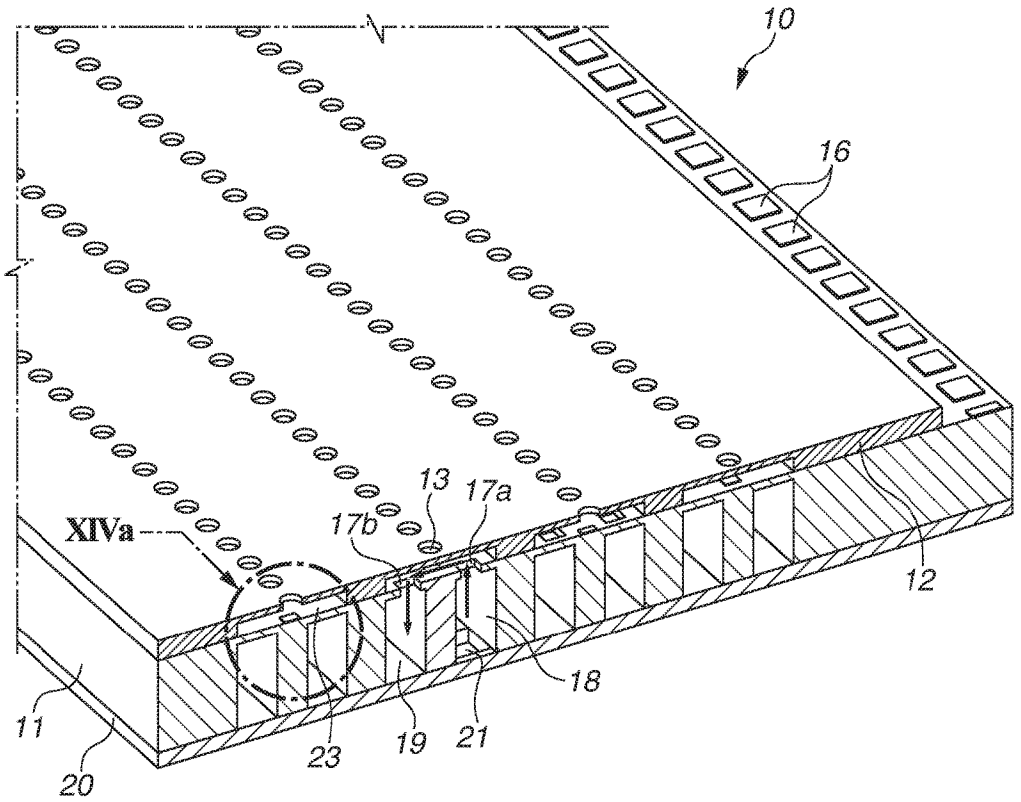
FIG. 12 is a cross-sectional view of the element substrate taken along line XII-XII specified in FIG. 10.

The cover member 20 functions as a cover which is a part of walls of the supply path 18 and the collection path 19 formed in the substrate 11 of the element substrate (refer to FIG. 12). Desirably, the cover member 20 has sufficient corrosion resistance with respect to the inks. Further, the openings 21 need to be formed in accurate shape in accurate positions in order to prevent the mixing of ink colors. Thus, the openings 21 are desirably formed by photolithography using a photosensitive resin material or a silicon plate as a material of the cover member 20. The openings 21 of the cover member 20 define pitches between the supply path 18 and the communication opening 51 and between the collection path 19 and the communication opening 51. Thus, in view of pressure loss, the cover member 20 is desirably thin and is desirably formed from, for example, a film-shaped member.

FIG. 12 is a perspective view illustrating the element substrate 10 taken along line XII-XII specified in FIG. 10. In the element substrate 10, the substrate 11 made of silicon (Si) and the ejection opening formed member 12 made of photosensitive resin are layered, and the cover member 20 is joined to a rear surface of the substrate 11. One surface side of the substrate 11 includes the heat generation elements 15, and the other surface side of the substrate 11 includes grooves forming the supply paths 18 and the collection paths 19 along the ejection opening arrays L. The supply paths 18 and the collection paths 19 formed by the substrate 11 and the cover member 20 are connected to the common supply channel 211 and the common collection channel 212, respectively, in the channel member 210 to generate a differential pressure between the supply paths 18 and the collection paths 19. The differential pressure between the supply paths 18 and the collection paths 19 causes the inks to flow as specified by arrows in FIG. 12 in the ejection openings 13 from which no ink is ejected during the printing operation in which the inks are ejected from the ejection openings 13 of the ejection head 3. Specifically, the ink in the supply path 18 flows through the supply opening 17*a*, the pressure chamber 23, the collection opening 17*b*, and then into the collection path 19. The flow of ink as described above makes it possible to collect into the collection path 19 the thickened inks generated by evaporation from the ejection openings 13 and foreign matter, such as bubbles, in the pressure chamber 23 and the ejection openings 13 that are inactive in the printing operation. Further, the thickening of the inks in the ejection openings 13 and the pressure chamber 23 is prevented. The inks in the collection path 19 flow through the openings 21 of the cover member 20, the liquid communication openings 31 of the support member 30 (refer to FIG. 9B), the communication openings 51 in the channel member 210, the separate collection channels 214, and the common collection channel 212, in this order, and are eventually collected into the ink supply path of the printing apparatus 1000.

Specifically, ink supplied from the main body of the printing apparatus to the ejection head 3 flows and is supplied and collected as follows. First, the ink flows into the ejection head 3 through the connection portion 111 of the supply unit 220, passes through the channels of the joint rubber 100, and is then supplied to the communication openings 72 and the common channel grooves 71 of the third channel member 70. After that, the ink is supplied to the common channel grooves 62 and the communication openings 61 of the second channel member 60 and then the separate channel grooves 52 and the communication openings 51 of the first channel member 50. Then, the ink flows through the liquid communication openings 31 of the support member 30, the openings 21 of the cover member 20, and then the supply path 18 and the supply opening 17*a* of the substrate 11 and is then supplied to the pressure chamber 23. The ink that is supplied to the pressure chamber 23 and is not ejected from the ejection openings 13 flows through the collection opening 17*b* and the collection path 19 of the substrate 11, the openings 21 of the cover member 20, and then the liquid communication openings 31 of the support member 30. After that, the ink flows through the communication opening 51 and the separate channel grooves 52 of the first channel member 50, the communication openings 61 and the common channel grooves 62 of the second channel member 60, the common channel grooves 71 and the communication openings 72 of the third channel member 70, and then the channels of the joint rubber 100. Then, the ink flows out of the ejection head 3 through the connection portion 111 of the supply unit 220.

In the first circulation path illustrated in FIG. 2, the ink that flows in the supply unit 220 through the connection portion 111A passes through the negative pressure control unit 230 and is then supplied through the channels of the joint rubber 100. Meanwhile, in the second circulation path illustrated in FIG. 3, the ink collected from the pressure chamber 23 passes through the channels of the joint rubber 100, the negative pressure control unit 230, and the connection portion 111A, in this order, and then flows out of the ejection head 3.

Further, not all the ink that flows in from one end of the common supply channel 211 of the ink the ejection unit 300 is supplied to the pressure chamber 23 through the separate supply channel 213 as illustrated in FIGS. 2 and 3. Specifically, some of the ink that flows in from one end of the common supply channel 211 flows into the supply unit 220 from the other end of the common supply channel 211 without flowing through the separate supply channel 213. Such a channel is provided to allow the ink to flow without flowing through the element substrate 10 as described above. In this way, even in the case in which the element substrates 10 including fine channels with high flow resistance are included as in the present exemplary embodiment, the flowing back of circulated ink (circulation flow) is prevented. Accordingly, the ink near the pressure chamber and the ejection openings is prevented from thickening in the ejection head according to the present exemplary embodiment. As a result, this prevents position errors in an ink ejection direction and defective ejections, leading to high-quality image printing.

(Positional Relationship between Element Substrates)

Figure 13:
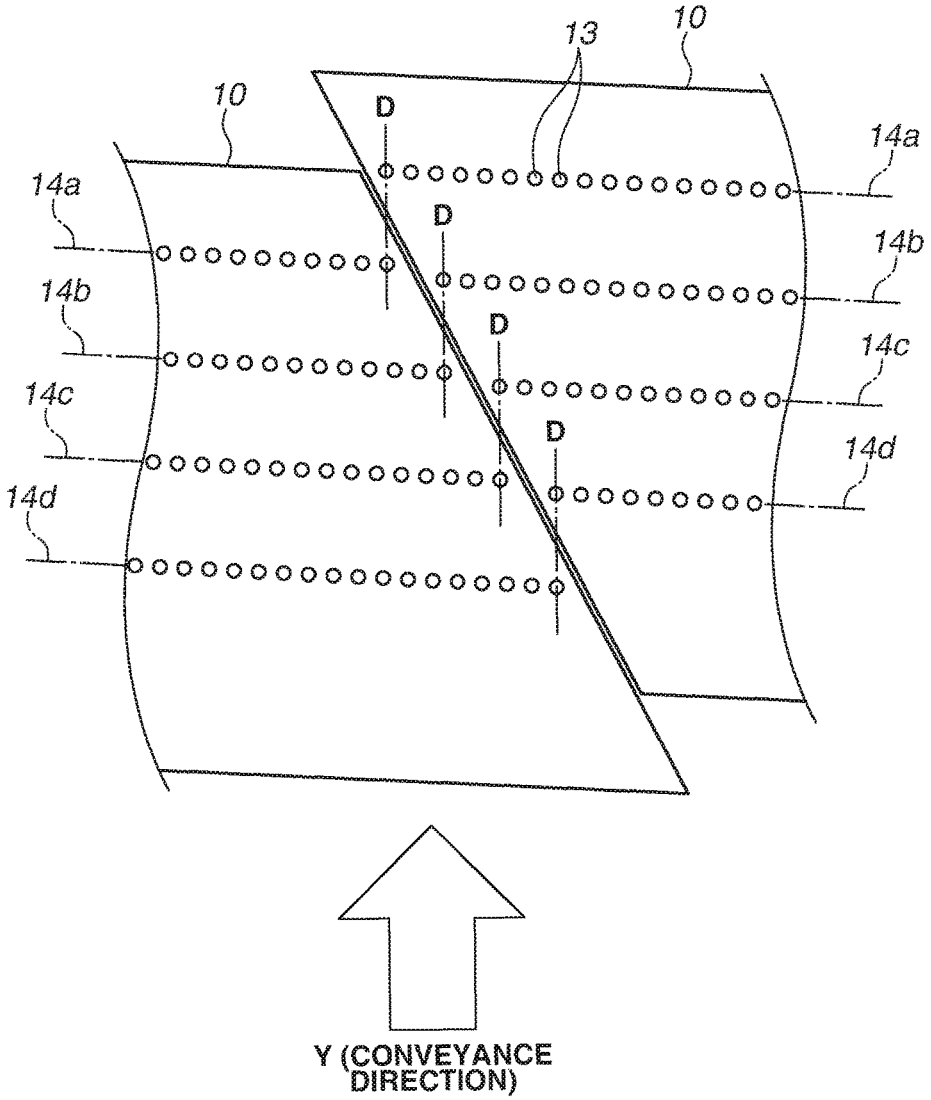
FIG. 13 is an enlarged view illustrating adjacent portions of two element substrates.

FIG. 13 is an enlarged plan view illustrating adjacent portions of the element substrates 10. In the present exemplary embodiment, the element substrate 10 is substantially parallelogram as illustrated in FIG. 10, and an ejection opening array 14 (14*a*, 14*b*, 14*c*, 14*d*) is arranged so as to be inclined at a predetermined angle with respect to the direction in which a printing medium is conveyed, as illustrated in FIG. 13. Consequently, the ejection opening arrays 14 in the adjacent portions of the element substrates 10 have at least one ejection opening overlapping each other in the direction in which a printing medium to be printed is conveyed. In FIG. 13, the two ejection openings 13 on each line D overlap each other. With this arrangement, even if the position of the element substrate 10 is slightly shifted from a predetermined position, black streaks and white streaks on a printed image can be made less visible by controlling the driving of the overlapping ejection openings 13. With the configuration illustrated in FIG. 13, even when the plurality of element substrates 10 is arranged in a straight line (in-line) instead of being staggered, an increase in length of the ejection head 3 in the direction in which a printing medium is conveyed is reduced. Further, occurrence of black streaks and white streaks in portions of printed images that correspond to the connected portions of the element substrates 10 is reduced. The planar shape of the element substrates 10 is not limited to the substantially parallelogram shape and can be any other shape, such as a rectangular or trapezoidal shape.

(Heating Element)

Figure 14A:
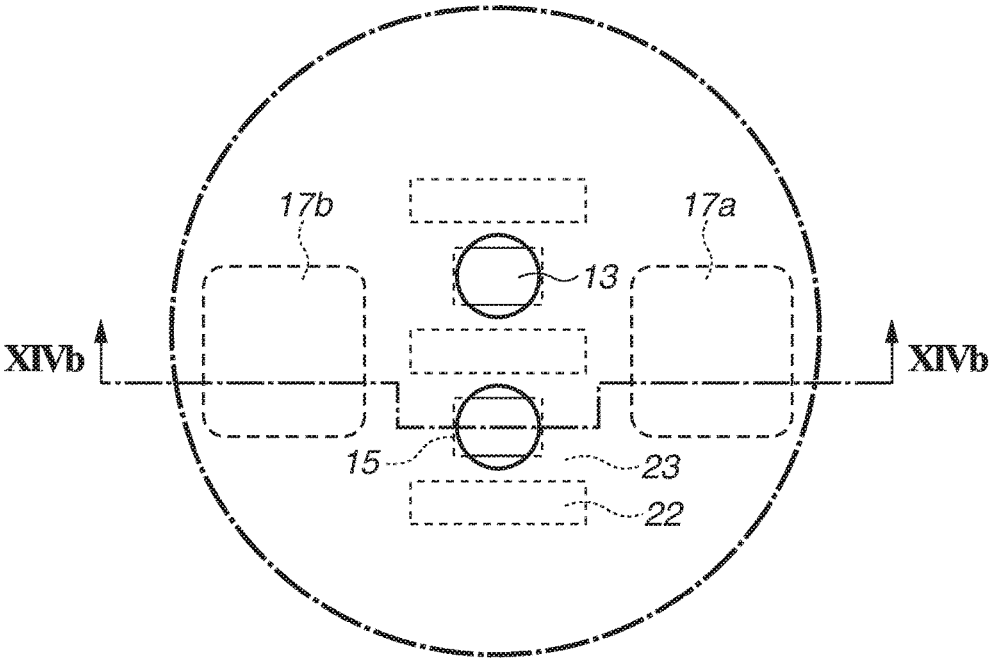
FIGS. 14A and 14B are enlarged views each illustrating an ejection opening portion of the element substrate.
Figure 14B:
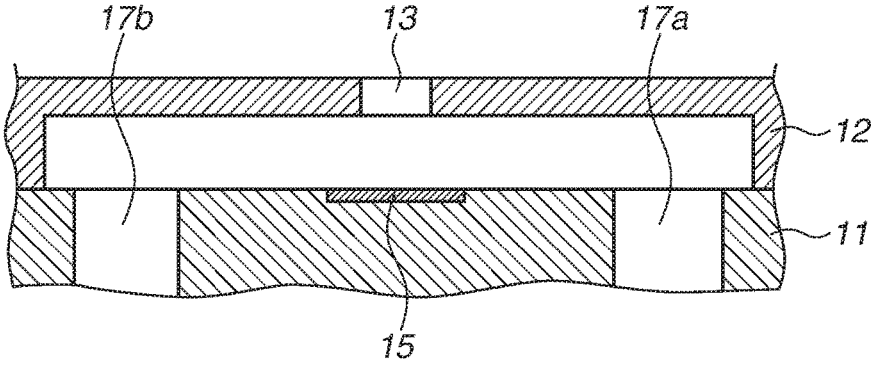

FIG. 14A is a plan view illustrating a portion XIVa specified in FIG. 12. FIG. 14B is a cross-sectional view along line XIVb-XIVb specified in FIG. 14A. The ink supplied from a supply opening 17*a* flows into the pressure chamber 23 located between the channel walls 22. The ink is heated by the heat generation element 15 to bubble in the pressure chamber 23 so that the ink is ejected from the ejection opening 13 using the bubble generating energy. The ink that is not ejected from the ejection opening 13 flows into the collection opening 17*b* as described above.

FIGS. 15A to 15E illustrate an ink ejection mechanism. The distance La from the substrate 11 to an external opening portion of the ejection opening 13 is smaller than 15 μm, e.g., 10 μm. The height of the pressure chamber 23, i.e., distance Lb from the substrate to the ejection opening formed member 12, is, for example, 5 μm. The thickness Lc of the ejection opening formed member 12 (depth of the ejection opening 13) is, for example, 5 μm. The heat generation element 15 is, for example, a heat generation resistor (heater) in the shape of a planar square having four sides each having a length Ld of 18 μm. The ejection opening 13 is, for example, a planar circle with a diameter Le of 16 μm.

Figure 15A:
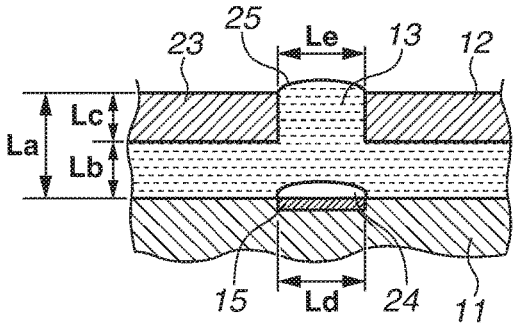
FIGS. 15A to 15E illustrate a basic liquid ejection operation.
Figure 15B:
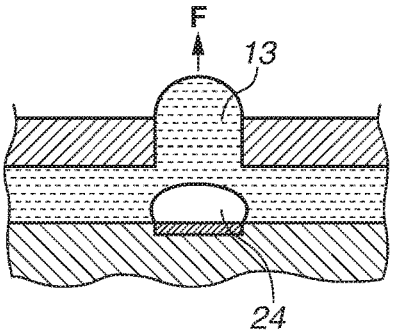
Figure 15C:
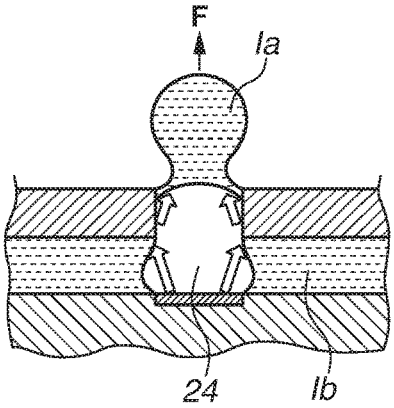
Figure 15D:
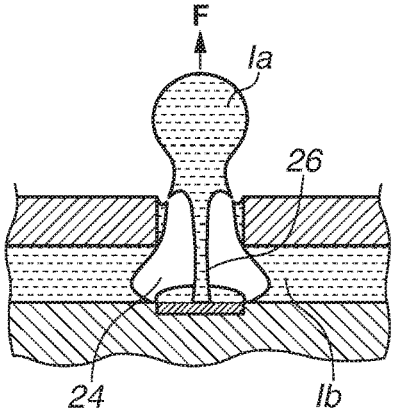
Figure 15E:
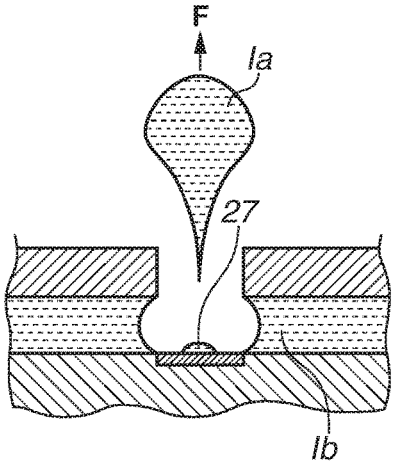

To eject ink, first, the heat generation element is driven to generate heat, and the heat energy is applied to the ink to produce a bubble 24. When the bubble 24 is produced, pressure is generated to extrude the ink forming a meniscus 25 in the ejection direction specified by an arrow F (FIGS. 15A and 15B). The volume of the bubble 24 increases and, as illustrated in FIG. 15C, the bubble 24 enters the ejection opening 13 to separate an ink droplet Ia, which is in the process of being ejected in the direction of the arrow F, and an ink Ib in the pressure chamber 23. After the bubble 24 grows to reach a maximum volume, the volume of the bubble 24 starts decreasing. As the bubble 24 shrinks, a rear portion 26 of the ink droplet Ia moves toward the heat generation element 15 as illustrated in FIG. 15D. In this process, a difference in speed arises between a front end portion (main droplet) of the ink droplet Ia in the direction of the arrow F and the rear portion 26 in the opposite direction to the ink ejection direction. Consequently, a long and thin tail portion of the ink droplet Ia is formed. Further, in this process, the bubble 24 communicates with the outside air as illustrated in FIG. 15D. Then, as illustrated in FIG. 15E, the ink droplet Ia is separated from the ink Ib in the pressure chamber 23 and ejected to the outside from the ejection opening 13, and the tail portion is eventually absorbed by the front end portion of the ink droplet Ia. The rear portion 26 of the ink droplet Ia remains as residual ink 27 on the heat generation element 15.

As described above, the distance La from the substrate 11 to the ejection openings 13 is set smaller than 15 μm so that the ink droplet Ia and the ink Ib in the pressure chamber 23 are separated by the bubble 24 and the tail portion of the ink droplet Ia becomes short. This prevents generation of satellite droplets (small ink droplets) following the ink droplet Ia.

Then, as illustrated in FIGS. 16A to 16E, the pressure chamber 23 is refilled with ink. In each of FIGS. 16A to 16E, the left hand side is a cross-sectional view of the pressure chamber 23, and the right hand side is a plan view of the pressure chamber 23 In the plan views, illustration of the ejection openings 13 is omitted to avoid complication.

Figure 16A:
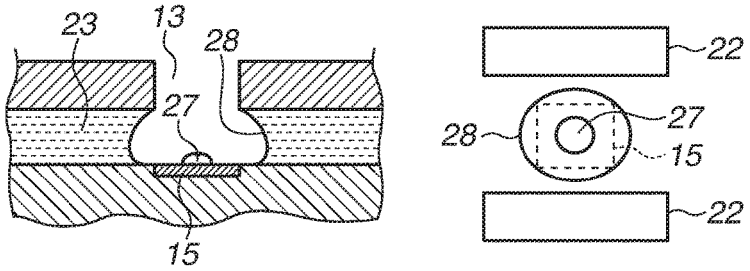
FIGS. 16A to 16E illustrate a liquid refilling operation.
Figure 16B:
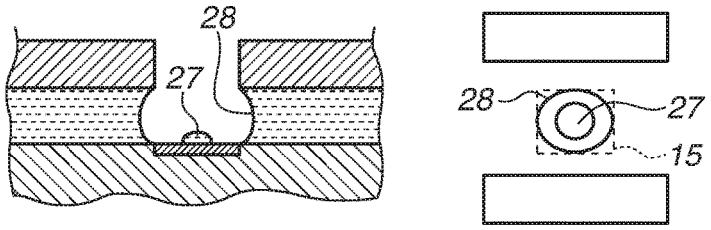
Figure 16C:
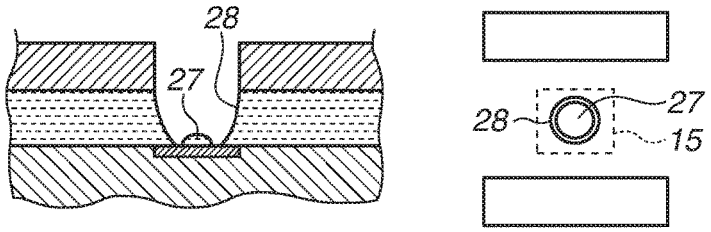
Figure 16D:
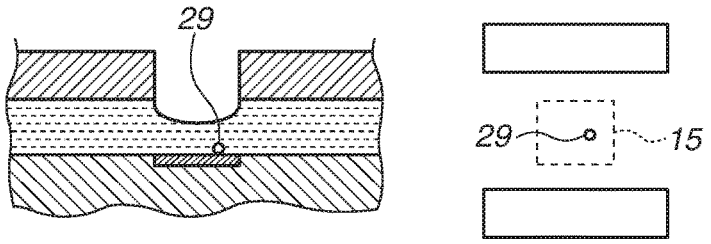

Immediately after the ejection of the ink droplet Ia, the residual ink 27 is on the heat generation element as illustrated in FIG. 16A, and since the bubble 24 communicates with the air as described above, the residual ink 27 is surrounded by a gas-liquid interface of the ink Ib in the pressure chamber 23. The gas-liquid interface 28 converges toward a center of the heat generation element 15 over time as illustrated in FIGS. 16B and 16C. During the time, at least a portion of the heat generation element 15, i.e., a region (surrounding portion) between the residual ink 27 located near the center of the heat generation element 15 and the gas-liquid interface 28 around the residual ink 27, is exposed to the air. Eventually, the ink Ib in the pressure chamber 23 joins the residual ink 27. In this process, a small bubble (residual small bubble) can be trapped in the ink at a position on the heat generation element 15 where a gas-liquid interface of the residual ink 27 joins the gas-liquid interface 28 of the ink Ib in the pressure chamber 23 (FIG. 16D). As a result of the joining of the residual ink 27 and the ink Ib in the pressure chamber 23, the ejection opening 13 is filled with the ink and a meniscus is formed as illustrated in FIG. 16E.

As described above, the distance La from the substrate 11 to the ejection opening 13 is set smaller than 15 μm so that a portion of the heat generation element 15 is exposed to the air during the time from the ejection of the ink droplet Ia to the refilling with the ink.

Figure 16E:
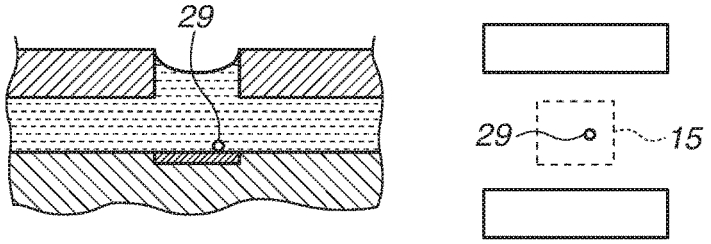

FIGS. 17A to 17G illustrate a comparative example to describe an effect of a residual small bubble (hereinafter, also referred to as "residual bubble") 29 on the ink ejection in the case in which the residual bubble 29 is trapped in the ink as illustrated in FIG. 16E.

Figure 17A:
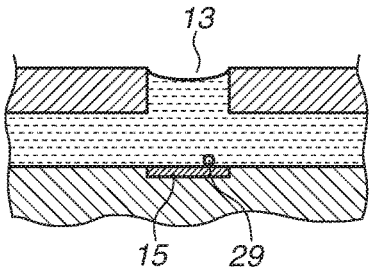
FIGS. 17A to 17G illustrate a liquid ejection operation according to a comparative example.
Figure 17B:
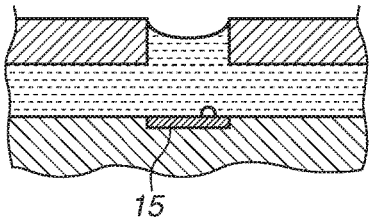
Figure 17C:
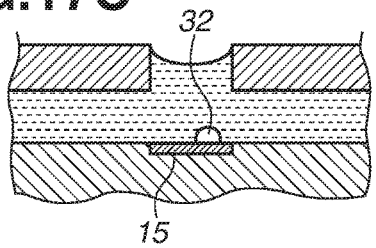
Figure 17D:
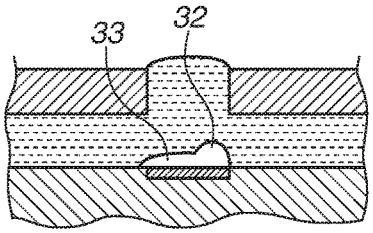
Figure 17E:
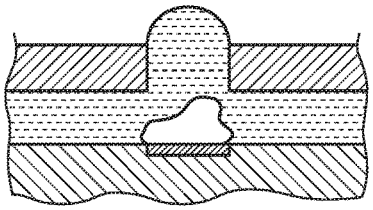
Figure 17F:
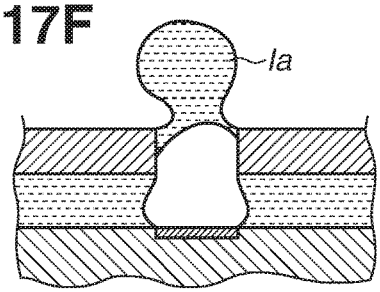
Figure 17G:
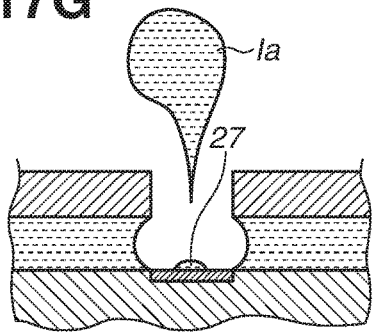

When the residual bubble 29 is present on the heat generation element 15 as illustrated in FIG. 17A, the heat generation element 15 is driven to heat the ink at a heat flux of $5.5\times10^8$ W/m$^2$ for one microsecond. In an early stage of the heating, the residual bubble 29 grows as illustrated in FIGS. 17B and 17C. The growth of the residual bubble 29 is started at a lower temperature than a film boiling temperature (for water, about 300 degrees Celsius) of the ink. Specifically, a nucleate boiling bubble 32 is produced by nucleate boiling of the ink. Then, when the temperature of the heat generation element 15 reaches the film boiling temperature of the ink, film boiling of the ink around the heat generation element 15 occurs, and a bubble 33 is produced by the film boiling (FIG. 17D). The bubble 33 joins the nucleate boiling bubble 32 to form one bubble (FIG. 17E). Thereafter, as illustrated in FIGS. 17F and 17G, the ink droplet Ia is ejected from the ejection opening 13. In this case, sufficient kinetic energy cannot be applied to the ink droplet Ia due to the nucleate boiling bubble 32 which grows at a lower temperature than the film boiling temperature, so the ejection speed decreases. Further, as illustrated in FIG. 17C, the position of the nucleate boiling bubble 32 is shifted from the center of the heat generation element 15, so an asymmetric bubble grows on the heat generation element 15 as illustrated in FIGS. 17D to 17F. Consequently, the ink droplet Ia is ejected in an oblique direction which is different from a normal direction of the substrate 11, as illustrated in FIG. 17G. In the case in which the ink is heated by the heat generation element 15 under the above-described driving condition as in the comparative example, the maximum reached temperature of the surface of the heat generation element 15 is about 600 degrees Celsius.

In FIGS. 15A to 15E and 17A to 17G, the residual ink 27 is illustrated symmetrically about a central axis of the heat generation element 15. However, in actual ink bubbling and ejection operations, the shape and size of the residual ink 27 are random to some extent. Thus, whether the residual bubble 29 is produced and where it is produced vary between ink ejection operations. For example, while no residual bubble 29 is produced and the ink droplet Ia is ejected straight at an adequate ejection speed in one ejection operation, the residual bubble 29 is produced and the ink droplet Ia is ejected in an oblique direction at a low ejection speed in another ejection operation. This is an ejection instability phenomenon, and the disclosure is to solve such a phenomenon. Specifically, as described above, in the case in which the distance La from the substrate 11 to the ejection openings 13 is set smaller than 15 μm, production of satellite droplets is prevented, but the ejection of the ink droplet Ia can be instable as in the comparative example illustrated in FIG. 17.

The ejection speed instability phenomenon is more likely to occur when the driving frequency of the heat generation element 15 that corresponds to the ink ejection repetition period is high. When the driving frequency of the heat generation element 15 is low, the residual bubble is absorbed by the ink and is not likely to cause nucleate boiling, but when the driving frequency of the heat generation element 15 is high, the next ink heating starts before the residual bubble 29 is absorbed by the ink.

In the present exemplary embodiment, the ink is heated by the heat generation element 15 at a heat flux of, for example, $8\times10^8$ W/m$^2$ for 0.5 microseconds. The total amount of heat input in the present exemplary embodiment is $5.5\times10^8$ W/m$^2$, which is substantially equal to the amount in the case in which the ink is heated for one microsecond as in the above-described comparative example. FIGS. 18A to 18F illustrate the ink ejection operation of the case in which the heat generation element 15 is driven under such a condition.

Figure 18A:
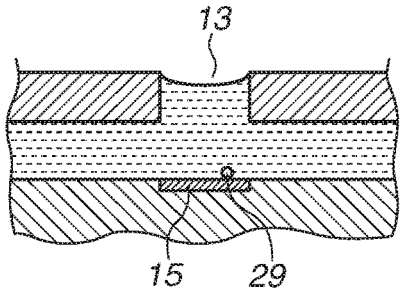
FIGS. 18A to 18F illustrate a liquid ejection operation.
Figure 18B:
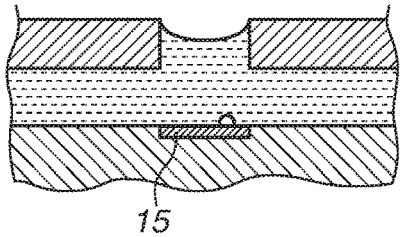
Figure 18C:
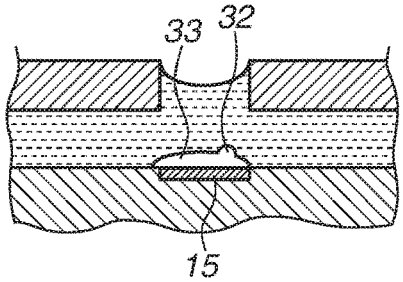
Figure 18D:
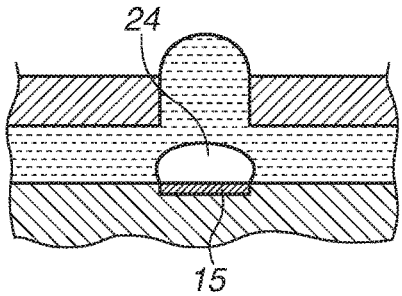
Figure 18E:
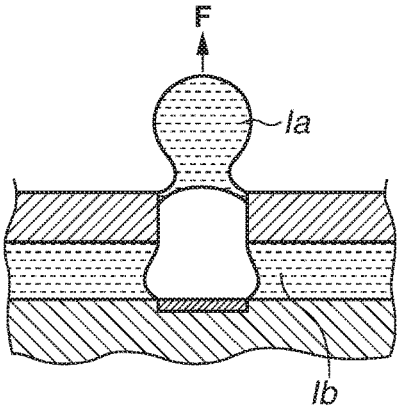
Figure 18F:
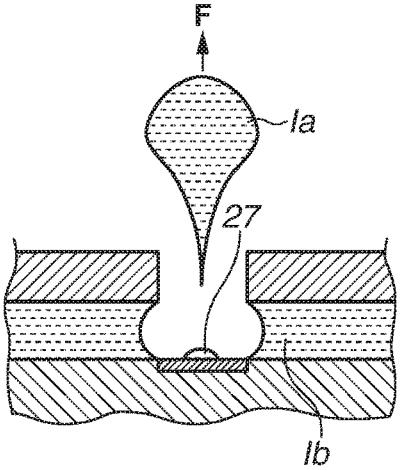

As illustrated in FIG. 18A, when the residual bubble 29 is present on the heat generation element 15, the heat generation element is driven under the above-described condition. In an early stage of the heating, the residual bubble 29 grows slightly as illustrated in FIG. 18B, but the film boiling temperature is reached immediately, so the nucleate boiling bubble 32 and the bubble 33 produced by the film boiling join immediately as illustrated in FIG. 18C to form the bubble 24 which is substantially uniform as illustrated in FIG. 18D. Then, the ink droplet Ia is ejected as illustrated in FIGS. 18E and 18F. In the ejection of the ink droplet Ia, the film boiling is dominant, so the ejection speed of the ink droplet Ia does not decrease. Further, the ink droplet Ia is ejected by the substantially symmetric bubble 24, so the ejection direction is substantially the same as the normal direction of the substrate 11. In the case in which the ink is heated by the heat generation element 15 under the driving condition according to the present exemplary embodiment, the maximum reached temperature of the surface of the heat generation element 15 is about 600 degrees Celsius as in the above-described comparative example.

Figure 19A:
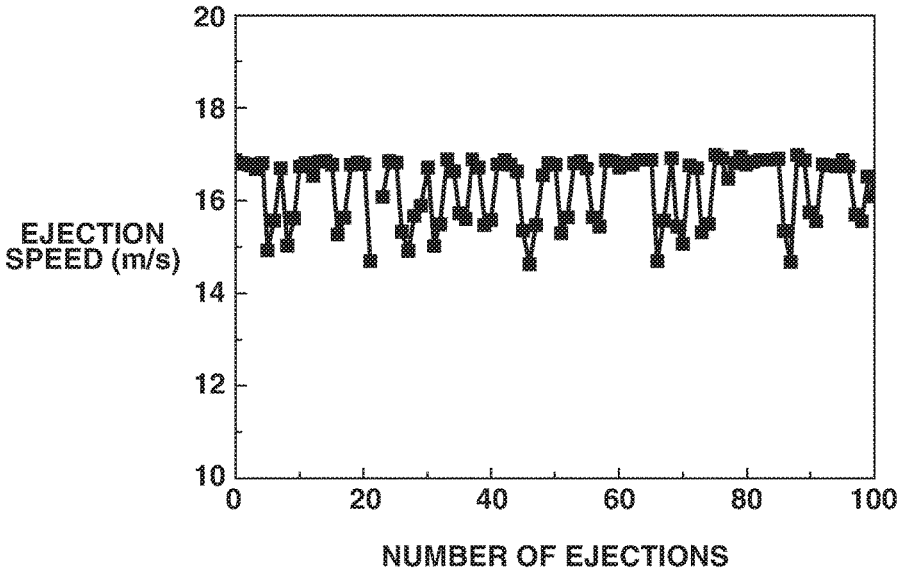
FIGS. 19A and 19B each illustrate a change in liquid ejection speed.
Figure 19B:
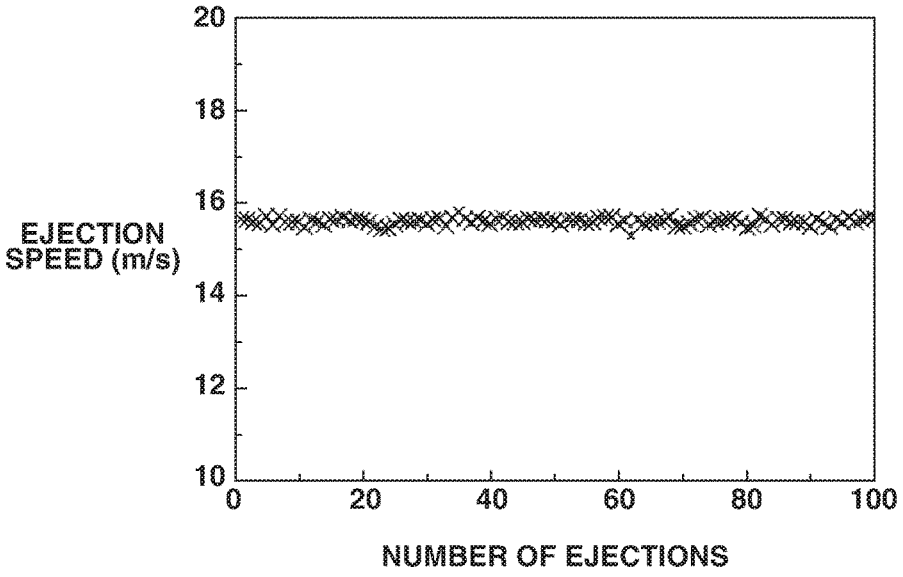

FIGS. 19A and 19B are graphs illustrating the ejection speed of each ink droplet in a case in which 100 ink droplets are ejected. FIG. 19A is a graph illustrating the ejection speed in the case in which the ink is heated at a heat flux of $5.5\times10^8$ W/m$^2$ for 1.0 microseconds and then an ink droplet is ejected as in the above-described comparative example. FIG. 19B is a graph illustrating the ejection speed in the case in which the ink is heated at a heat flux of $8\times10^8$ W/m$^2$ for 0.5 microseconds and then an ink droplet is ejected as in the present exemplary embodiment. From the graphs it is apparent that the ejection speed is stable in the case in which the ink droplet is ejected under the driving condition of the heat generation element as in the present exemplary embodiment.

Figures 20A, 20B:
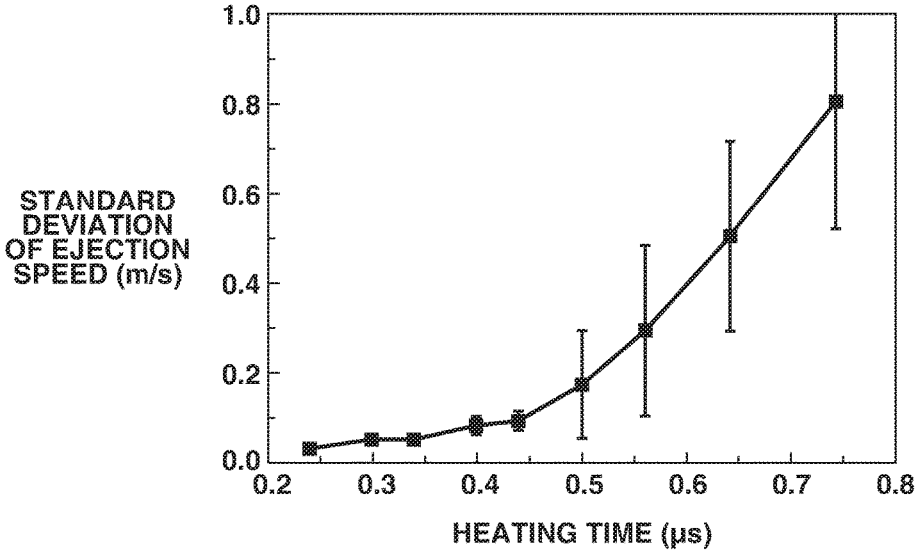
FIGS. 20A and 20B illustrate a relationship between liquid heating time and standard deviation of the liquid ejection speed.

FIG. 20A is a graph with the horizontal axis showing the ink heating time and the vertical axis showing the standard deviation of the ejection speed of ink droplets. Specifically, the ejection speed of each of 100 ink droplets ejected from one ejection opening is measured, and a standard deviation $\sigma_i$ of the measured ejection speeds is calculate This is performed for nine ejection openings. A mean value of the nine standard deviations $\sigma_i$ is plotted, and each error bar in FIG. 20A indicates variations in standard deviation between the ejection openings. The amount of heat input at the time of ink droplet ejection is the same regardless of the ink heating time. From the graph it is apparent that the shorter the heating time is, the more stable the ink droplet ejection speed is. Especially when the heating time is 0.5 microseconds or shorter, the ink droplet ejection speed is sufficiently stable. This enables fine image printing.

FIG. 20B illustrates the relationship between the standard deviation of the ejection speed and a result of visual sensory evaluation of the quality of printed images. Basically, when the standard deviation of the ink droplet ejection speed exceeds 0.2 m/s, defects on a printed image become noticeable, and the quality of the printed image decreases. Further, when the standard deviation of the ink droplet ejection speed exceeds 0.1 and does not exceed 0.2, the quality of a printed image is high. When the standard deviation of the ejection speed does not exceed 0.1, uniformity in image quality is high, and the image quality is excellent. Thus, in the visual sensory evaluation of the quality of printed images, the standard deviation of the ink droplet ejection speed that is not higher than 0.2 m/s is determined as being acceptable. From FIG. 20B it is apparent that when the standard deviation of the ejection speed is 0.5 m/s, printing quality within an acceptable range is ensured.

As described above, in the arrangement in which the distance La from the substrate 11 to the ejection opening 13 is set smaller than 15 μm and a part of the heat generation element 15 is exposed to the air after the ink droplet ejection, the heat generation element 15 is driven at a heat flux of $8\times10^8$ W/m$^2$ or higher (heating time: 0.5 microseconds or shorter). This enables ejection of ink droplet to be stable while production of satellite droplets is prevented.

In a case in which the distance La from the substrate 11 to the ejection opening 13 is not smaller than 15 μm, the communication of the bubble 24 with the air is delayed. Specifically, the bubble 24 communicates with the air after the gas-liquid interface of the residual ink 27 joins the gas-liquid interface 28 of the ink Ib in the pressure chamber 23. Thus, the heat generation element 15 is not exposed to the air, and no residual bubble 29 is produced, so ink nucleate boiling is not likely to occur in the next ink bubbling.

Figure 21A:
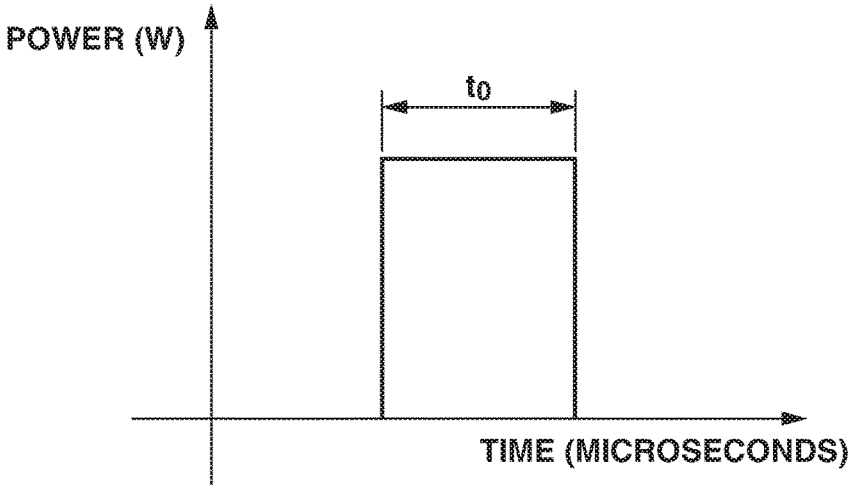
FIGS. 21A and 21B illustrate driving pulses according to a second exemplary embodiment of the disclosure.

In the above-described first exemplary embodiment, as illustrated in FIG. 21A, the heat generation element 15 is heated once per ink droplet ejection, and the driving pulse (pulse width: t0) is one. The driving pulse can be divided into a plurality of pulses.

Figure 21B:
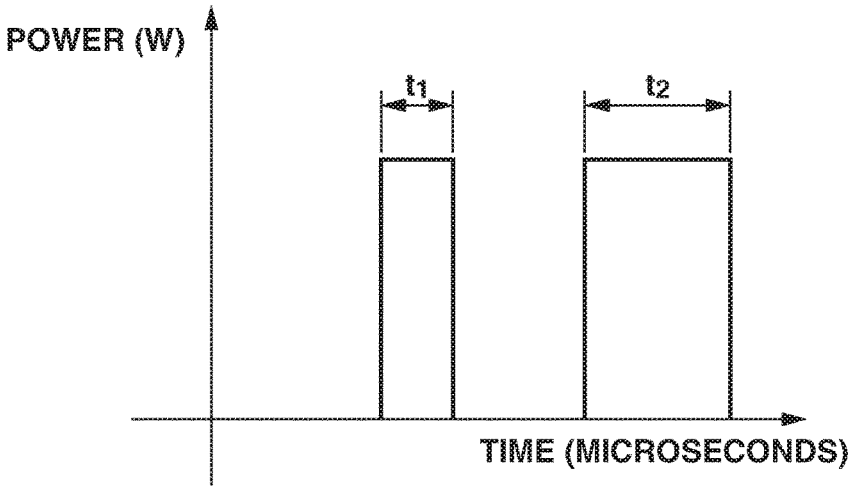

FIG. 21B illustrates the driving pulse of the heat generation element 15 according to a second exemplary embodiment of the disclosure. A plurality of driving pulses is applied to the heat generation element 15, which is a heat generation resistor, for each ink droplet ejection. In the present exemplary embodiment, two driving pulses (pulse width: t1, t2) are applied. The ink is heated at a heat flux of $8\times10^8$ W/m$^2$ or higher so that even if the residual bubble 29 is present on the heat generation elements 15, since the film boiling is dominant in the ink droplet ejection, ink droplets can be stably ejected while production of satellite droplets is prevented, as described above. In the case in which the driving pulse of the heat generation element 15 is divided into a plurality of pulses and the ink is heated a plurality of times, some of the heat is dissipated and lost during the non-heating time between the driving pulses. Thus, the total heating time for the case of using the plurality of driving pulses is set longer by about 10% than the heating time for the case of using a single pulse as in FIG. 21A.

FIGS. 22A to 22C and 23 illustrate a third exemplary embodiment of the disclosure. In each of FIGS. 22A to 22C, the left hand side is a cross-sectional view of the pressure chamber 23, and the right hand side is a plan view of the pressure chamber 23. In the plan views, illustration of the ejection openings 13 is omitted to avoid complication.

Figure 22A:
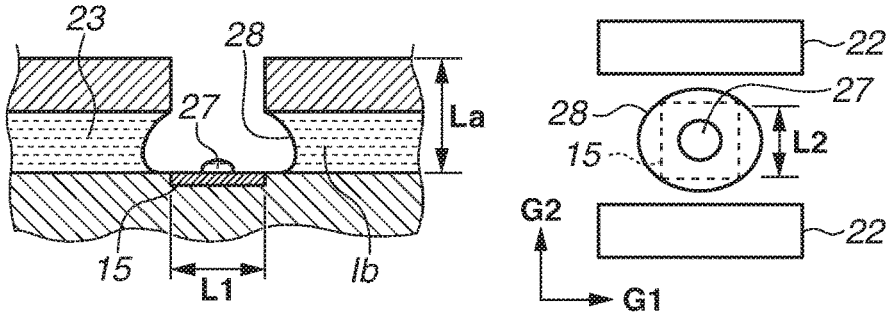
FIGS. 22A to 22C illustrate a relationship between an aspect ratio and liquid bubbling according to a third exemplary embodiment of the disclosure.
Figure 22B:
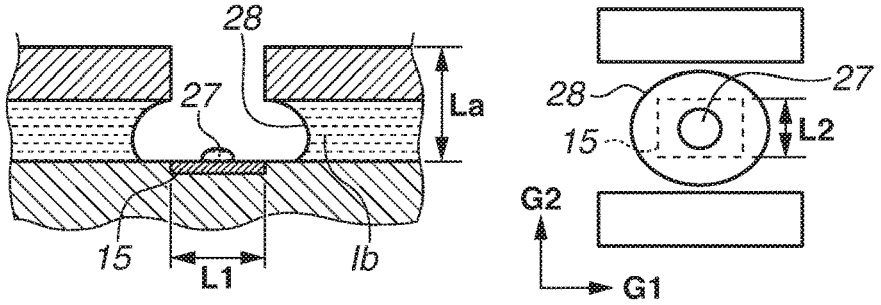
Figure 22C:
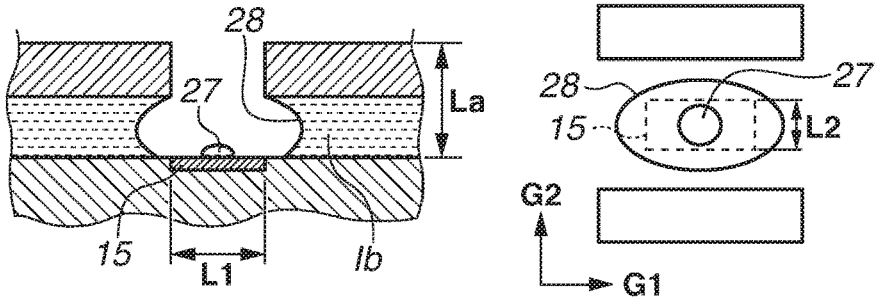

The heat generation element 15 according to the above-described first exemplary embodiment is a 18 μm×18 μm planar square. However, the planar shape of the heat generation element 15 can be, for example, a rectangle as illustrated in FIGS. 22B and 22C. The planar shape of the heat generation element 15 illustrated in FIG. 22B is a 21.8 μm×15 μm (aspect ratio: 1.45) rectangle. Specifically, a side of the heat generation element 15 in FIG. 22B that is parallel to a direction (direction G1) in which ink channels between the adjacent channel walls 22 extend has a length L1 of 21.8 μm, and a side along a direction (direction G2) that is orthogonal to the direction in which the ink channels extend has a length L2 of 15 μm. Further, the distance La from the substrate 11 to the ejection opening 13 is 14 μm. Further, the heat generation element 15 illustrated in FIG. 22A is a square with an aspect ratio of 1, and the heat generation element 15 illustrated in FIG. 220 is a rectangle with an aspect ratio of 2.24.

The shape of the gas-liquid interface 28 of the ink Ib in the pressure chamber 23 varies depending on the aspect ratio of the heat generation element 15. In the direction of an arrow G2, the bubble 24 does not grow much because it is blocked by the channel walls 22. Therefore, the size of the gas-liquid interface 28 in the direction of the arrow G2 is substantially equal regardless of the aspect ratio of the heat generation element 15. On the other hand, in the direction of an arrow G1, the higher the aspect ratio of the heat generation elements 15 is and the longer the length L1 in the direction of the arrow G1 is, the larger the gas-liquid interface 28 grows. In the case in which the aspect ratio of the heat generation element 15 is high, a larger area of the heat generation element 15 is exposed to the air for a long time, so the residual bubble is more likely to be produced. Thus, in order to stabilize the ink droplet ejection speed, the heat generation element 15 needs to be driven so as to further reduce the ink heating time.

Figure 23:
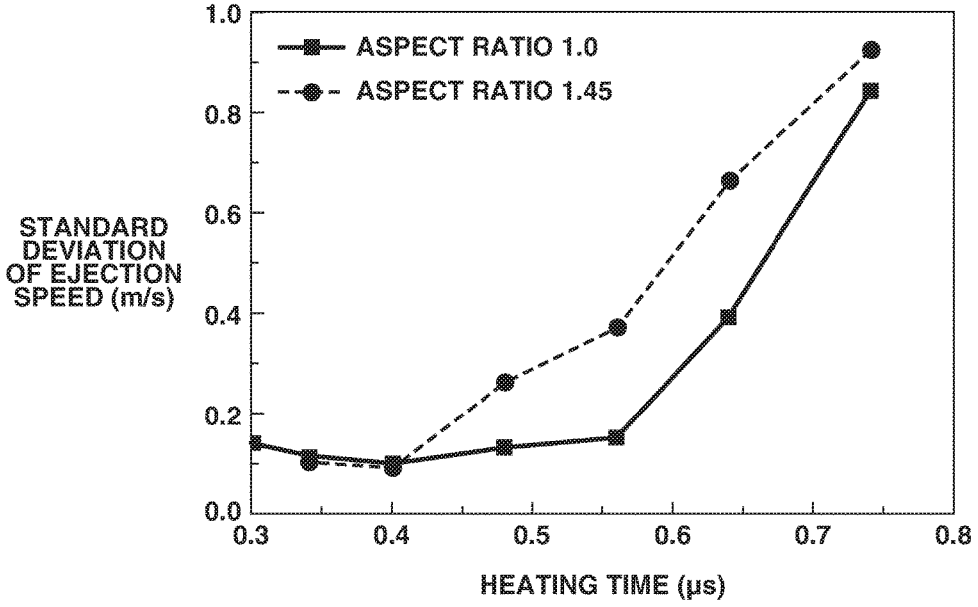
FIG. 23 illustrates the relationship between the aspect ratio and the standard deviation of the liquid ejection speed.

FIG. 23 illustrates the relationship between the ink heating time and the standard deviation of the ink droplet ejection speed in the cases in which the aspect ratio of the heat generation element 15 is 1.0 and 1.45. From FIG. 23 it is apparent that even when the aspect ratio is 1.45, the ink droplet ejection speed is stable if the ink heating time is reduced. The aspect ratio of the heat generation element 15 is desirably 1.5 or lower, more desirably 1.4 or lower, and even more desirably 1.2 or lower. By increasing the aspect ratio of the heat generation element 15, the resistance value of the heat generation element 15 which is a heat generation resistor is increased to produce heat in an amount that is needed to bubble the ink with a smaller amount of electric current.

Figure 24A:
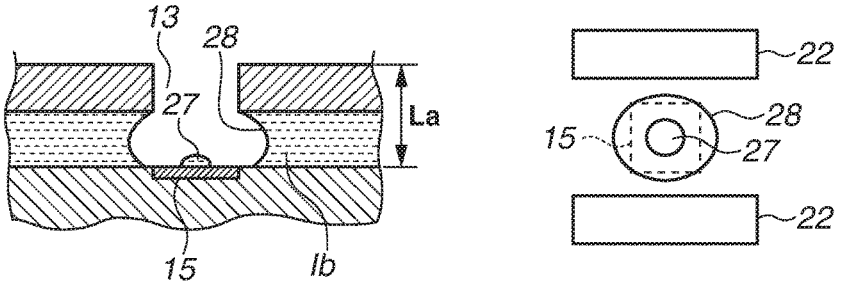
FIGS. 24A and 24B illustrate a relationship between a size of ejection opening and liquid bubbling according to a fourth exemplary embodiment of the disclosure.
Figure 24B:
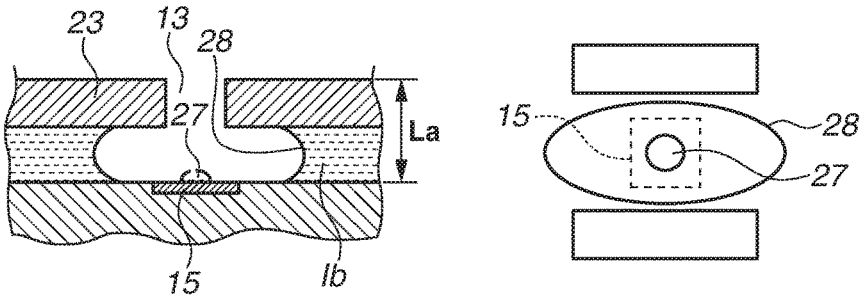

FIGS. 24A and 24B illustrate a fourth exemplary embodiment of the disclosure. In each of FIGS. 24A and 24B, the left hand side is a cross-sectional view of the pressure chamber 23, and the right hand side is a plan view of the pressure chamber 23. In the plan views, illustration of the ejection openings 13 is omitted to avoid complication.

In the first exemplary embodiment described above, the planar shape of the heat generation element 15 is a 18 μm×18 μm square, and the planar shape of the ejection opening 13 is a circle with a diameter of 16 μm. In the present exemplary embodiment, the planar shape of the ejection opening 13 is a circle with a diameter of 20 μm. Thus, as illustrated in FIG. 24A, the length of a side of the heat generation element 15 is smaller than the diameter of the ejection opening 13. The distance La from the substrate 11 to the ejection opening 13 is 10 μm as in the first exemplary embodiment.

In the case in which the distance La is smaller than 15 μm, if the diameter of the ejection opening 13 is larger than the length of a side of the heat generation element 15, the gas-liquid interface 28 is likely to increase in size as illustrated in FIG. 24B, because when the ejection opening 13 is small, the bubble 24 produced when the ink is bubbled extends widely in the pressure chamber 23. In the case in which the gas-liquid interface 28 is large, a larger area of the heat generation element 15 is exposed to the air for a long time, so the residual bubble 29 is more likely to be produced as in the third exemplary embodiment. Thus, in order to stabilize the ink droplet ejection speed, the heat generation element 15 needs to be driven so as to further reduce the ink heating time.

Accordingly, in the present exemplary embodiment, as illustrated in FIG. 24A, the length of a side of the heat generation element 15 is set smaller than the diameter of the ejection opening 13, to realize more stable ink droplet ejections. The diameter of the ejection opening 13 can be any diameter longer than the longer side of the heating surface formed by the heat generation element 15. Further, the planar shape of the ejection opening 13 is not limited to the circle and can be, for example, a rectangle, oval, ellipse, circle having a protrusion, etc. The size relationship between the ejection opening 13 and the heat generation element 15 is based on the diameter of a circumcircle of the ejection opening 13.

Figure 25:
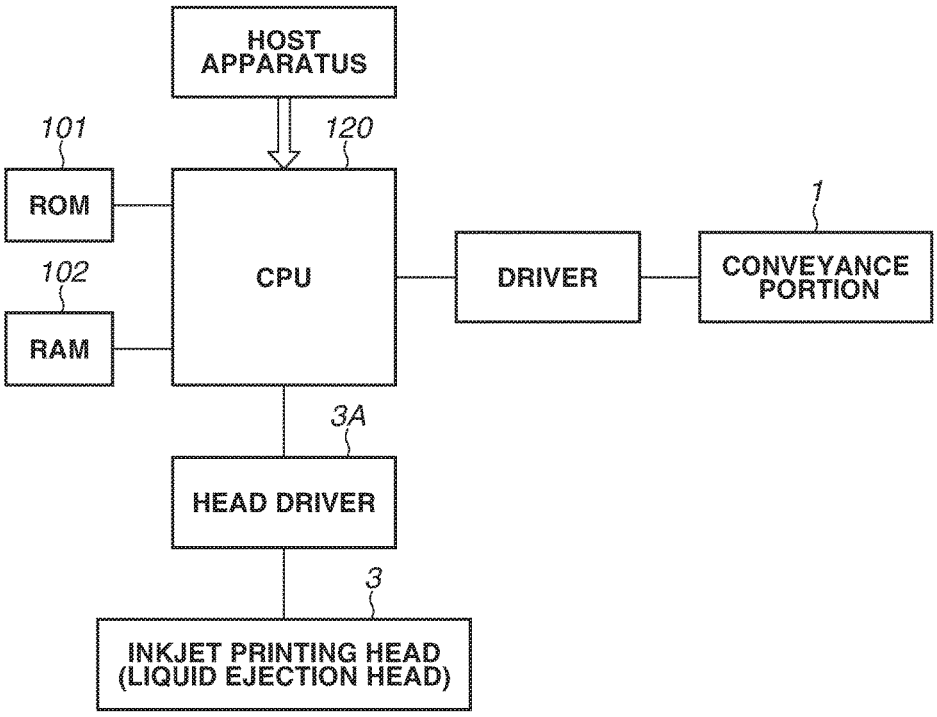
FIG. 25 is a block diagram illustrating a control system of the liquid ejection apparatus illustrated in FIG. 1.

FIG. 25 is a block diagram illustrating an example of the configuration of the control system of the line inkjet printing apparatus (liquid ejection apparatus) 1000 illustrated in FIG. 1. A central processing unit (CPU) 120 executes control processing, data processing, etc. for the operations of the printing apparatus 1000. A read-only memory (ROM) 101 stores programs of procedures of the processing, etc. A random access memory (RAM) 102 is used as a work area, etc. for the execution of the processing. The inkjet printing head (liquid ejection head) 3 includes the plurality of ejection openings from which ink (liquid) can be ejected as described above. The CPU 120 drives the heat generation elements 15 via a head driver 3A to eject ink from the ejection openings of the ejection head 3 as described above. The CPU 120 functions as the control unit configured to control the driving of the heat generation elements 15 forming the heating surface under the above-described condition.

The disclosure is also applicable to a serial scan printing apparatus. The serial scan printing apparatus includes a printing head placed on a carriage which is movable in a main scan direction, and a printing medium is conveyed in a sub-scan direction which intersects the main scan direction. While the printing head and the carriage are moved together in the main scan direction, the operation in which the ink is ejected and the operation in which the printing medium is conveyed in the sub-scan direction are repeated to print an image on the printing medium.

The disclosure is applicable not only to the inkjet printing methods, the inkjet printing apparatuses, and the inkjet printing heads but also to liquid ejection methods, liquid ejection apparatuses, and liquid ejection heads for ejecting various liquids. For example, the disclosure is applicable to apparatuses, such as printers, copying machines, facsimiles including a communication system, word processors including a printer unit, and commercial printing apparatuses combined with various processing apparatuses. Further, the disclosure is applicable to the manufacture of biochips, the printing of electronic circuits, etc. According to the disclosure, the liquid heating condition is specified to efficiently eject liquid while the liquid ejection state is stabilized.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-140350, filed Jul. 15, 2016, which is hereby incorporated by reference herein in its entirety.

What is claimed is:

1. A liquid ejection method comprising:

ejecting liquid from an ejection opening; and using a liquid ejection head including a heating surface configured to heat the liquid and the ejection opening corresponding to the heating surface, by heating the liquid with the heating surface to produce a bubble communicating with air through the ejection opening such that at least a part of the heating surface is exposed to the air through the ejection opening, wherein the liquid is heated with the heating surface for 0.5 microseconds or shorter to produce a bubble communicating with the air through the ejection opening such that at least a part of the heating surface is exposed to the air through the ejection opening, in order to eject the liquid from the ejection opening.

2. A liquid ejection method comprising:

ejecting liquid from an ejection opening; and using a liquid ejection head including a heating surface configured to heat the liquid and the ejection opening corresponding to the heating surface, by heating the liquid with the heating surface to produce a bubble communicating with air through the ejection opening such that at least a part of the heating surface is exposed to the air through the ejection opening, wherein the liquid is heated with the heating surface at a heat flux of $8\times10^8$ W/m$^2$ or higher to produce a bubble communicating with the air through the ejection opening such that at least a part of the heating surface is exposed to the air through the ejection opening, in order to eject the liquid from the ejection opening.

3. The liquid ejection method according to claim 1, wherein during a process of ejecting the liquid from the ejection opening, a portion of the liquid ejected from the ejection opening is caused to remain in a central portion of the heating surface, and wherein a surrounding portion which is a part of the heating surface outside the central portion is exposed to outside air.

4. The liquid ejection method according to claim 3, wherein after the liquid is ejected from the ejection opening, the liquid remaining in the central portion of the heating surface and filling liquid from the surrounding portion of the heating surface toward the central portion join on the heating surface.

5. The liquid ejection method according to claim 1, wherein a planar shape of the heating surface is a rectangle with an aspect ratio of 1.5 or lower.

6. The liquid ejection method according to claim 1, wherein the heating of the liquid with the heating surface to eject the liquid from the ejection opening is divided into a plurality of times of heating, and wherein a total time of the plurality of times of heating is 0.5 microseconds or shorter.

7. The liquid ejection method according to claim 1, wherein a distance between a substrate to which the heating surface is provided and an external opening portion of the ejection opening is smaller than 15 μm.

8. The liquid ejection method according to claim 1, wherein a diameter of the ejection opening is longer than a longer side of the heating surface.

9. A liquid ejection apparatus comprising:

an ejection opening that ejects liquid using a liquid ejection head including a heating surface for heating the liquid and the ejection opening corresponding to the heating surface, by heating the liquid with the heating surface to produce a bubble communicating with air through the ejection opening such that at least a part of the heating surface is exposed to the air through the ejection opening, wherein the heating surface heats the liquid for 0.5 microseconds or shorter to produce a bubble communicating with the air through the ejection opening such that at least a part of the heating surface is exposed to the air through the ejection opening, in order to eject the liquid from the ejection opening.

10. A liquid ejection apparatus comprising:

an ejection opening that ejects liquid using a liquid ejection head including a heating surface for heating the liquid and the ejection opening corresponding to the heating surface, by heating the liquid with the heating surface to produce a bubble communicating with air through the ejection opening such that at least a part of the heating surface is exposed to the air through the ejection opening, wherein the heating surface heats the liquid at a heat flux of $8\times10^8$ W/m$^2$ or higher to produce a bubble communicating with the air through the ejection opening such that at least a part of the heating surface is exposed to the air through the ejection opening, in order to eject the liquid from the ejection opening.

11. A liquid ejection head comprising:

a heating surface for heating a liquid; and an ejection opening corresponding to the heating surface, wherein the liquid ejection head ejects the liquid from the ejection opening by heating the liquid with the heating surface for 0.5 microseconds or shorter to produce a bubble communicating with air through the ejection opening such that at least a part of the heating surface is exposed to the air through the ejection openings, wherein a planar shape of the heating surface is a rectangle with an aspect ratio of 1.5 or lower, wherein a distance between a substrate to which the heating surface is provided and an external opening portion of the ejection opening is smaller than 15 μm, and wherein a diameter of the ejection opening is longer than a longer side of the heating surface.

12. A liquid ejection head comprising:

a heating surface for heating a liquid; and an ejection opening corresponding to the heating surface, wherein the liquid ejection head ejects the liquid from the ejection opening by heating the liquid with the heating surface at a heat flux of $8\times10^8$ W/m$^2$ or higher to produce a bubble communicating with air through the ejection opening such that at least a part of the heating surface is exposed to the air through the ejection openings, wherein a planar shape of the heating surface is a rectangle with an aspect ratio of 1.5 or lower, wherein a distance between a substrate to which the heating surface is provided and an external opening portion of the ejection opening is smaller than 15 μm, and wherein a diameter of the ejection opening is longer than a longer side of the heating surface.

13. The liquid ejection head according to claim 11, wherein the heating surface is formed by an electrothermal transduction element.

14. The liquid ejection head according to claim 13, further comprising:

a pressure chamber in which the electrothermal transduction element is provided, wherein liquid in the pressure chamber is circulated between the pressure chamber and a portion outside the pressure chamber.

* * * * *